US011565271B2

(12) United States Patent
Bennington

(10) Patent No.: US 11,565,271 B2
(45) Date of Patent: Jan. 31, 2023

(54) AGGREGATE WASHING SYSTEMS, METHODS AND APPARATUS

(71) Applicant: Superior Industries, Inc., Morris, MN (US)

(72) Inventor: John Bennington, Indianola, IA (US)

(73) Assignee: Superior Industries, Inc., Morris, MN (US)

( * ) Notice: Subject to any disclaimer, the term of this patent is extended or adjusted under 35 U.S.C. 154(b) by 1028 days.

(21) Appl. No.: 15/622,189

(22) Filed: Jun. 14, 2017

(65) Prior Publication Data

US 2017/0361332 A1 Dec. 21, 2017

Related U.S. Application Data

(60) Provisional application No. 62/382,752, filed on Sep. 1, 2016, provisional application No. 62/350,776, filed on Jun. 16, 2016.

(51) Int. Cl.

| | |
|---|---|
| ***B03B 5/02*** | (2006.01) |
| ***B03B 5/52*** | (2006.01) |
| ***B04B 5/02*** | (2006.01) |
| ***B07B 13/16*** | (2006.01) |
| ***B08B 3/04*** | (2006.01) |
| ***B01F 23/53*** | (2022.01) |
| ***B01F 27/60*** | (2022.01) |
| ***B01F 27/1144*** | (2022.01) |
| ***B01F 27/192*** | (2022.01) |

(Continued)

(52) U.S. Cl.

CPC ..... *B03B 5/02* (2013.01); *B01F 23/53* (2022.01); *B01F 27/1144* (2022.01); *B01F 27/1921* (2022.01); *B01F 27/62* (2022.01); *B03B 5/52* (2013.01); *B03B 5/62* (2013.01); *B04B 5/02* (2013.01); *B07B 13/16* (2013.01); *B08B 3/02* (2013.01); *B08B 3/042* (2013.01); *B03B 5/00* (2013.01); *B07B 1/00* (2013.01); *B07B 2230/01* (2013.01); *B08B 3/00* (2013.01)

(58) Field of Classification Search

CPC ..... B07B 2230/01; B07B 1/28; B07B 1/00; B03B 5/02; B03B 5/62; B03B 5/00; B08B 3/02; B08B 3/00

USPC ..... 209/13

See application file for complete search history.

(56) References Cited

U.S. PATENT DOCUMENTS 2,914,175 A * 11/1959 Fink ..... B07B 1/00 209/269

3,398,676 A 8/1968 Theoblad et al.

(Continued)

FOREIGN PATENT DOCUMENTS

DE 4343539 A1 6/1995

DE 19721629 C1 * 12/1998 ..... B03B 5/623

(Continued)

OTHER PUBLICATIONS

Terex "Aggrescrub 150" Brochure, May 2014, 12 pages. http://powerscreenofcalifornia.my.invictuslocal.com/wp-content/uploads/sites/7/2015/09/AGGRESCRUB-150-web-and-email.pdf.

(Continued)

*Primary Examiner* — Charles A Fox

*Assistant Examiner* — Michael E Butler

(74) *Attorney, Agent, or Firm* — Larkin Hoffman Daly & Lindgren, Ltd.; Todd R. Fronek

(57) ABSTRACT

Aggregate washing systems are described including mechanisms for slurrying, washing and/or dewatering aggregate material.

22 Claims, 26 Drawing Sheets

(51) Int. Cl.

| | |
|---|---|
| ***B03B 5/62*** | (2006.01) |
| ***B08B 3/02*** | (2006.01) |
| *B03B 5/00* | (2006.01) |
| *B07B 1/00* | (2006.01) |
| *B08B 3/00* | (2006.01) |

(56) References Cited

U.S. PATENT DOCUMENTS

| | | | | |
|---|---|---|---|---|
| 3,970,549 | A | 7/1976 | Ennis et al. | |
| 4,076,124 | A * | 2/1978 | Taysom | B07B 13/113 209/308 |
| 4,082,657 | A * | 4/1978 | Gage | B03B 4/02 209/311 |
| 4,100,248 | A | 7/1978 | Adams | |
| 4,113,626 | A | 9/1978 | Detcher | |
| 4,379,049 | A | 4/1983 | Bassett | |
| 4,632,751 | A | 12/1986 | Johnson et al. | |
| 4,701,266 | A * | 10/1987 | Janka | B01D 21/04 210/523 |
| 4,768,723 | A | 9/1988 | Fritz | |
| 4,844,362 | A | 7/1989 | Revnivtsev et al. | |
| 5,429,247 | A * | 7/1995 | Lemay | B07B 1/00 209/17 |
| 5,516,427 | A | 5/1996 | Koshikawa | |
| 5,552,044 | A | 9/1996 | Abel | |
| 5,795,484 | A * | 8/1998 | Greenwald, Sr. | B01D 33/042 210/696 |
| 6,168,102 | B1 | 1/2001 | Bergart | |
| 6,311,847 | B1 | 11/2001 | Soldwish-Zoole et al. | |
| 6,325,311 | B1 | 12/2001 | Preisser | |
| 6,467,964 | B2 | 10/2002 | Smith et al. | |
| 6,585,115 | B1 | 7/2003 | Reddoch et al. | |
| 7,073,433 | B2 | 7/2006 | Burke et al. | |
| 7,380,617 | B1 | 6/2008 | James | |
| 7,461,746 | B1 | 12/2008 | Egge et al. | |
| 8,695,804 | B2 | 4/2014 | Bennington, II et al. | |
| 2009/0054204 | A1 | 2/2009 | Nogi | |
| 2009/0057204 | A1* | 3/2009 | Bennington, II | B01D 33/0346 209/156 |
| 2010/0170859 | A1 | 7/2010 | Fout | |
| 2016/0083902 | A1* | 3/2016 | Henriksson | D21C 5/02 162/4 |

FOREIGN PATENT DOCUMENTS

| | | | |
|---|---|---|---|
| EP | 0072590 | B1 | 12/1986 |
| EP | 322688 | A2 | 7/1989 |
| EP | 1052014 | A2 | 11/2000 |
| FR | 1454244 | A | 7/1966 |
| GB | 1204954 | A | 9/1970 |
| WO | 20091032356 | A1 | 3/2009 |
| WO | 2015097272 | A1 | 7/2015 |
| WO | 2015122801 | A1 | 8/2015 |

OTHER PUBLICATIONS

Extended European Search Report, European Patent Office, dated Nov. 17, 2017.
GreyStone, Inc., "Aggre-Washer and Screening Plants", Brochure, 2001, pp. 1-2, Columbus, Nebraska.
GreyStone, Inc., "Complete Solutions", Brochure, Sep. 2003, pp. 1-2, Columbus, Nebraska.
GreyStone, Inc., "Coarse Material Washers and Blade Mill Aggregate Washers", Brochure, 2005, pp. 1-8.
GreyStone, Inc., "A New Solution to Dewatering", Brochure, Sep. 2013, pp. 1-2.
GreyStone, Inc., "Dewatering Screens", Brochure, Sep. 2013, pp. 1-8, Columbus, Nebraska.
GreyStone, Inc., "Fine Material Dewatering Screws", Brochure, 2003, pp. 1-8.
GreyStone, Inc., "Log Washers", Brochure, 2005, pp. 1-8.
GreyStone, Inc., "Aggre-Spec Classifying Systems", Brochure, 2002, pp. 1-4, Columbus, NE.
KPI-JCI Astec Compaies, "Washing and Classifying", Brochure, Aug. 2015, pp. 1-20, USA.
Weir Minerals Division, "Sizing and Dewatering Screens", Brochure, 2011, pp. 1-20, Madison, Wisconsin.
McLanahan, "Dewatering Screens", Brochure, May 2014, pp. 1-4, USA.
McLanahan, "Log Washers", Brochure, Jan. 2014, pp. 1-4, USA.
Pit and Quarry, "P&Q University Lesson 9—Washing & Classifying" Website, Sep. 10, 2015, pp. 1-11. http://www.pitandquarry.com/pq-university-lesson-9-washing-classifying/.
Bateman, Andy, "New Life for an Old Quarry" Blog post, Jan. 23, 2009, pp. 1-3. https://www.rocktoroad.com/aggregates/profiles/new-life-for-an-old-quarry-916.
Terex, "Washing Systems Technical Specification, Aggrescrub 150", Brochure, May 2014, pp. 1-10, Dungannon, Northern Ireland.
Trio Engineered Products, "Fine Material Washers", Brochure, 2004, pp. 1-2.

* cited by examiner

100

AGGREGATE WASHING SYSTEMS, METHODS AND APPARATUS

BACKGROUND

There is an increased interest in the bulk material handling industry and related industries for efficient use of resources (e.g., energy, water) during material processing. Existing washing equipment (e.g., sand screws) often uses undesirably high amounts of water.

Thus there is a need in the art for aggregate washing systems, methods, and apparatus having improved washing effectiveness and/or efficiency (e.g., water usage efficiency, energy efficiency, and/or processing time efficiency). As a non-limiting exemplary application, such aggregate washing systems may be used for washing and/or dewatering feeds of aggregate material.

DESCRIPTION

Processing Methods

Figure 17:
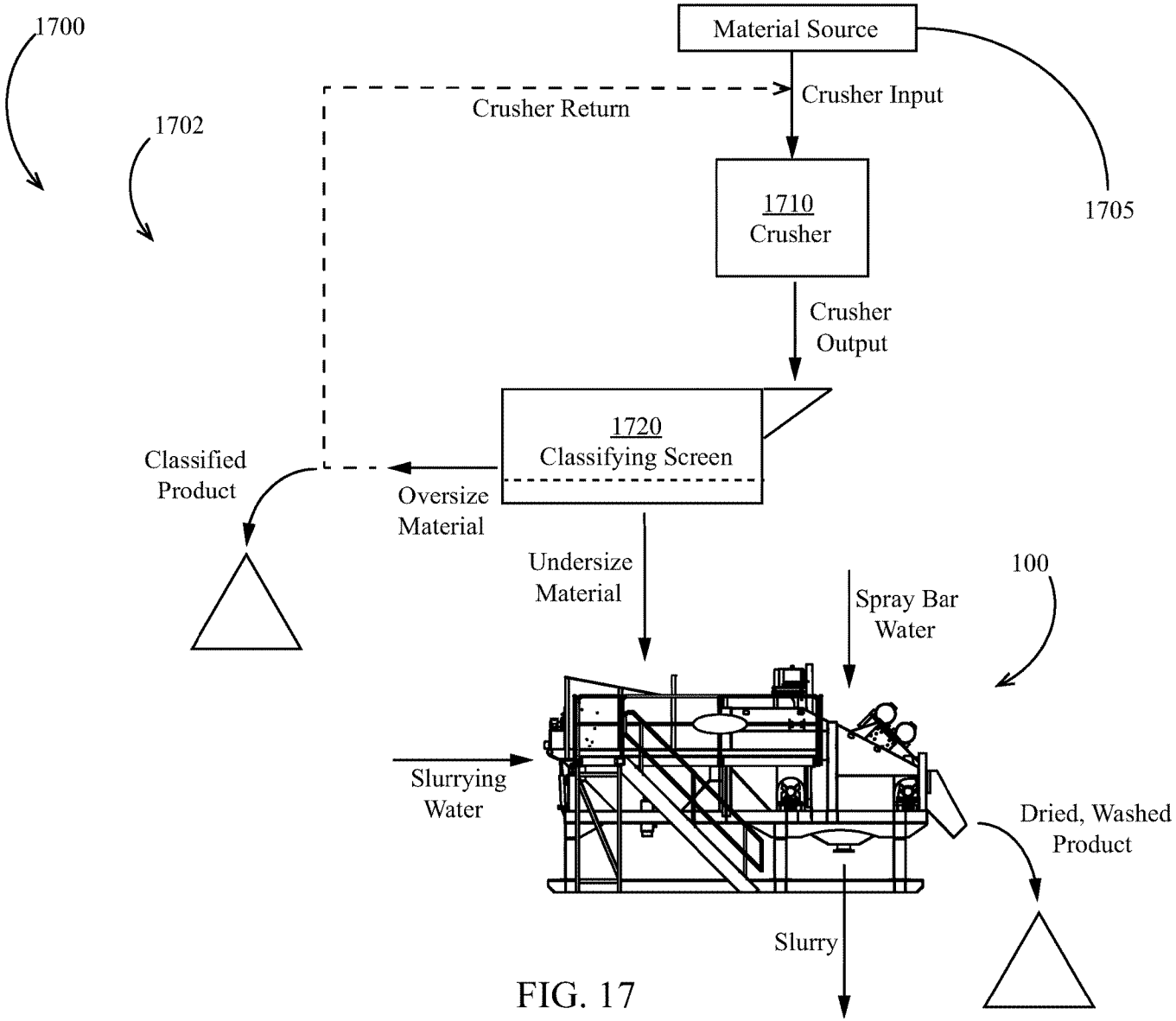
FIG. 17 schematically illustrates an embodiment of an aggregate processing plant and an embodiment of a process for aggregate processing.

Referring to the drawings, wherein like reference numerals designate identical or corresponding parts throughout the several views, FIG. 17 schematically illustrates an aggregate washing system 100 employed in an exemplary aggregate processing plant 1700 and a process 1702. It should be appreciated that the aggregate washing system embodiments described herein may be employed in other plant contexts with different processing steps preceding and following the aggregate washing system, and may also be used in self-standing implementations or other contexts separate from aggregate processing plants; the plant and process flows described herein are merely illustrative examples.

The plant 1700 and process 1702 optionally process material (e.g., comprising stone, gravel, sand, and/or fines, etc.), which may include contaminants, into an at least partially dried and/or at least partially washed product such as sand. The material may be transported and/or conveyed from a material source 1705 such as a stockpile, pit or quarry. Prior to being introduced into the aggregate washing system 100, the material is optionally processed to generate an input sized for processing by the aggregate washing system.

In some embodiments of the plant 1700 and process 1702, the material from material source 1705 is transported to the input of a crusher 1710 (e.g., cone crusher, jaw crusher, horizontal or vertical impact crusher, or other crushing apparatus). The crusher 1710 optionally reduces the median size of the material.

The crushed material reaching the crusher output may be classified such that only a subset of the crusher output having a first size range (e.g., undersize material) is transported to the aggregate washing system 100. A subset of the crusher output having a second size range (e.g., oversize material) may be transported back to the crusher input, and/or may be transported to another processing step or directly to a stockpile. In an exemplary classification step, the crusher output may be transported to a classifying screen 1720 (e.g., a vibratory screen such as a horizontal or incline screen, which may be a "dry" screen without washing elements or may alternatively include washing elements) having one or more (e.g., one to three) decks of screen media. In some embodiments the screen 1720 optionally has a minimum screen size (e.g., screen mesh size, screen opening size, etc.) of ⅜ inches or less, although other minimum screen sizes are used in other embodiments. The oversize material passed across the screen 1720 is optionally handled according to one of the alternatives described above. The undersize material passing through the screen may be referred to as throughs or fines and in some implementations may comprise material having a gradation of ⅜ inches or less in gradation, although other gradations may be used.

The material (optionally crushed and/or classified as described above) is optionally introduced into the aggregate washing system 100, which is described in more detail herein according to various embodiments. In some implementations, the material introduced into the aggregate washing system comprises dry material (which may be described as a dry feed in some embodiments) and/or primarily dry material. In one example, the material may comprise aggregate material to which water has not been added in a washing step and/or other plant processing step. In another example, the material may comprise aggregate material to which water has not been added in order to form a slurry. In another example, the material may comprise aggregate material which is transferred in dry and/or substantially dry condition using a conveyor such as a belt conveyor.

Water is optionally introduced into the aggregate washing system (e.g., in a slurrying mechanism thereof) in order to produce a mixture (e.g., slurry) containing the material. Water is optionally also introduced into the aggregate washing system via one or more washing elements (e.g., spray bars) disposed to remove contaminants and/or fines from the material. The washing system optionally includes a dewatering mechanism (e.g., a classifying mechanism such as a vibrating screen) which optionally allows water and contaminants and/or fines to pass through screen media thereof (e.g., forming an undersize slurry). The resulting undersize slurry may be transported for further processing or to waste storage. The output of the aggregate washing system 100 (e.g., material passing over the screen) optionally comprises at least partially washed (e.g., substantially washed, saleable, etc.) product. The output of the aggregate washing system 100 may be transported to a storage location such as a stockpile (e.g., by a conveyor such as a radial stacking conveyor).

Transportation steps described with respect to the plant 1700 and process 1702 may include the use of conveyors and/or vehicles. The crusher 1710 described herein may optionally comprise an embodiment disclosed in U.S. Pat. No. 4,844,362 or 4,768,723, both incorporated by reference herein in their entirety. The screen 1720 described herein may optionally comprise an embodiment disclosed in U.S. Pat. No. 4,632,751, incorporated by reference herein in its entirety.

Washing System General Structure and Operation

Referring to FIGS. 1-15, an exemplary embodiment of an aggregate washing system 100 is illustrated optionally including a slurrying mechanism 200 (which may be described as a slurry-forming mechanism, an agitator, agitating mechanism, mixer, mixing mechanism, stirring mechanism, slurrifier, slurrifying mechanism, slurry mixer, slurry mixing mechanism, etc. according to some embodiments) and optionally including a dewatering mechanism 300 (e.g., a classifying mechanism such as a vibrating screen), which may be arranged in series as illustrated such that material (e.g., slurry) processed by the slurrying mechanism 200 is transferred to the dewatering mechanism 300. The slurrying mechanism 200 and dewatering mechanism 300 are optionally supported by frames 20, 30, respectively which are described elsewhere herein. The frames 20, 30 may comprise sections of a single rigidly and/or releasably interconnected frame, or may be two independent and/or relatively movable frames. The frames 20, 30 may be mounted (e.g., by welding) to other structure or may be movably supported by skids, wheels or other mobile structure. Thus the aggregate washing system 100 may be deployed as a single mobile plant, as a plurality of separate mobile plants, or in a stationary plant setting.

The slurrying mechanism optionally generates a slurry comprising water and aggregate materials introduced to the mechanism through an inlet Is. The slurrying mechanism optionally passes the slurry (e.g., all or substantially all of the slurry exiting the slurrying mechanism) from an outlet Os thereof into an inlet Id of the dewatering mechanism. The dewatering mechanism optionally removes water (and/or fines or other undersize material) from the slurry and optionally passes at least partially washed (e.g., substantially washed, saleable, etc.) product (e.g., sand) through an outlet Od.

Slurrying Mechanism Embodiments

The slurrying mechanism 200 optionally comprises a tub 201 (which may also be described as a tank according to some embodiments) having an inlet Is for receiving aggregate material to be processed and an outlet Os for dispensing material from the interior of the slurrying mechanism 200 to the dewatering mechanism 300. The inlet Is optionally comprises an open upper end of the tub 201, which may include a rear wall 206, left sidewall 202, right sidewall 204, and forward wall 208. In alternative embodiments the tub 201 may include a lid having an opening and/or feedbox defining the inlet Is. Material (e.g., dry aggregate material) is optionally fed to the tub 201 in a region F above the tub generally shown in FIG. 3; the region F is optionally in a rearward portion of the tub 201 and optionally forward of an auger 420 (described elsewhere herein). The outlet Os optionally comprises an opening 290 in a floor 205 of the tub 201 as illustrated, and/or may comprise an opening in one of the sidewalls of the tub. The opening 290 is optionally formed at and/or near a forward end of slurrying mechanism 200, e.g., near and/or adjacent to the forward wall 208.

Water or other fluid (e.g., from a pond, tank or other water source) is optionally provided (in some embodiments exclusively provided) to the interior of the tub 201 by an inlet 270. The inlet 270 is optionally formed in and/or extends through a sidewall (e.g., optionally at a lower end thereof and optionally at a rearward end thereof) and optionally in fluid communication with a water source, e.g. by fitting to a hose or pipe (not shown). In alternative embodiments, the inlet 270 deposits water into the tub without extending through the sidewalls (e.g., by being disposed over the interior volume of the tub). In some embodiments, water is not provided to the tub 201 other locations other than the inlet 270 (e.g., is not introduced into the upper end of the tub 201). A restriction 207 (e.g., a metal plate or plate of other material having a plurality of holes or other openings therein) may be mounted to one or more walls of the tub 201 and/or to the floor 205. Water introduced into the inlet 270 optionally passes through holes in the restriction 207 in order to create rising currents in the water and/or slurry in the rearward end of the tub 201. The radially outer ends of the augers and paddle assemblies (described elsewhere herein) at the rearward end of the tub optionally pass through a region adjacent to the restriction 207. A selectively openable drain 212 (e.g., a pipe mounted and/or fitted to an opening in the tub 201 having a cap such as a threaded cap) is optionally provided in the tub 201 (e.g., at a rearward end thereof) and is optionally disposed in the rear wall 206 of the tub 201.

The rate at which water is introduced to inlet 270 is optionally controlled by a rate controller 1820 (FIG. 18) such as a valve (e.g., flow control valve). In some embodiments, water is introduced to the inlet 270 at a rate that is optionally between 1 and 3 (e.g., between 1 and 2, between 1 and 1.5, between 1.5 and 2, between 1.5 and 2.5, between 2 and 3, etc.) gallons per minute per ton per hour of material (e.g., dry aggregate material) introduced to the slurrying mechanism 200. In some applications, water is introduced to the inlet 270 at a rate that is optionally between 150 and 200 gallons per minute (e.g., between 150 and 160, between 150 and 165, between 150 and 170, between 150 and 175, between 150 and 180, between 150 and 185, between 150 and 190, between 150 and 195, between 190 and 200, between 180 and 200, between 170 and 200, between 160 and 200, etc.).

The slurrying mechanism 200 optionally includes a propulsion assembly 400. The propulsion assembly may have one or more functions which may include agitating the aggregate material and water to form a slurry (e.g., agitating, mixing, slurrifying, slurrying, etc.) and/or propelling the raw material, water and/or aggregate material generally forwardly to the opening Os. Rotation of the propulsion assembly 400 conveys the slurry toward outlet Os with the tank retaining substantially all water that does not exit the outlet Os.

Figure 6:
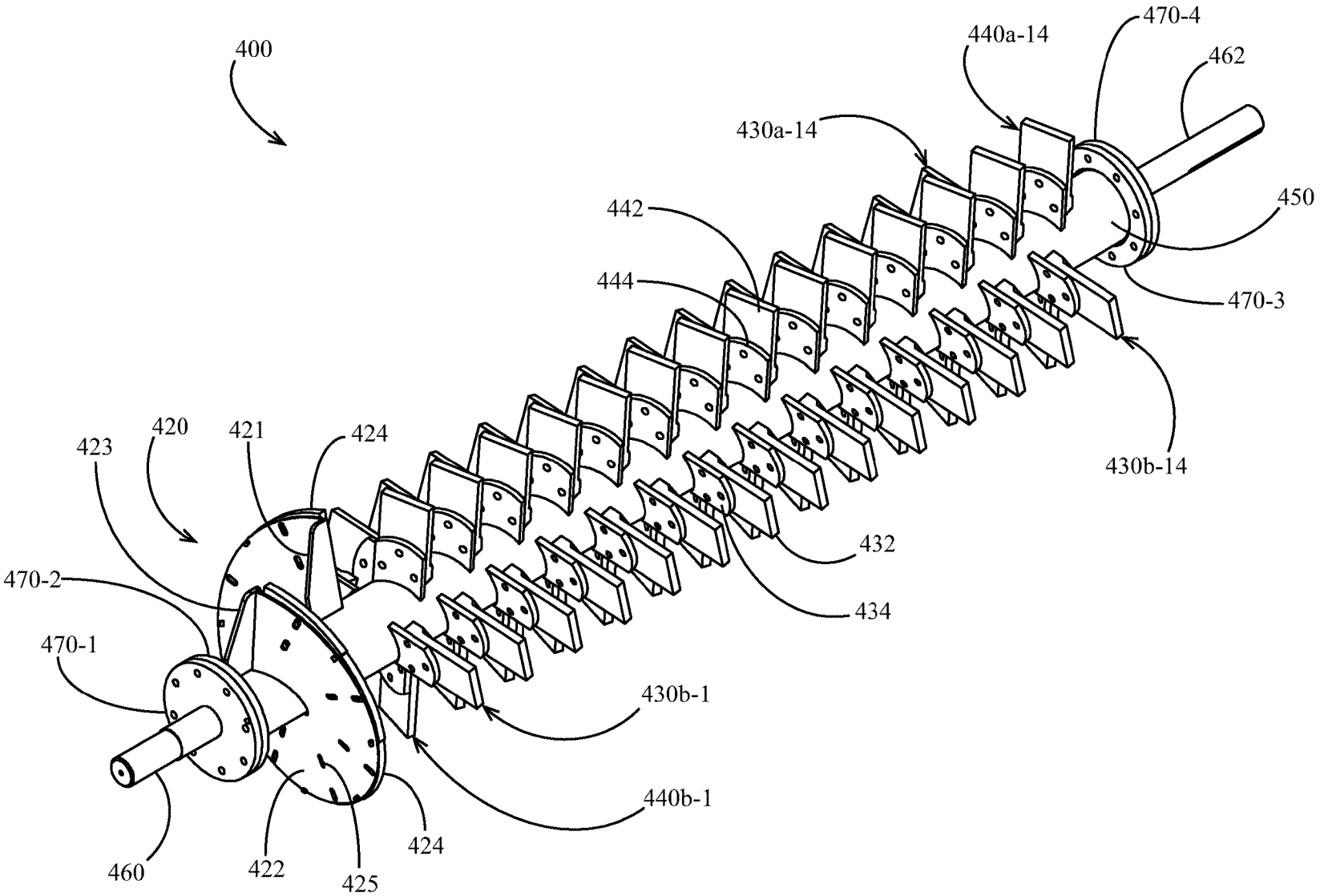
FIG. 6 is a perspective view of an embodiment of a propulsion assembly.
Figure 7:
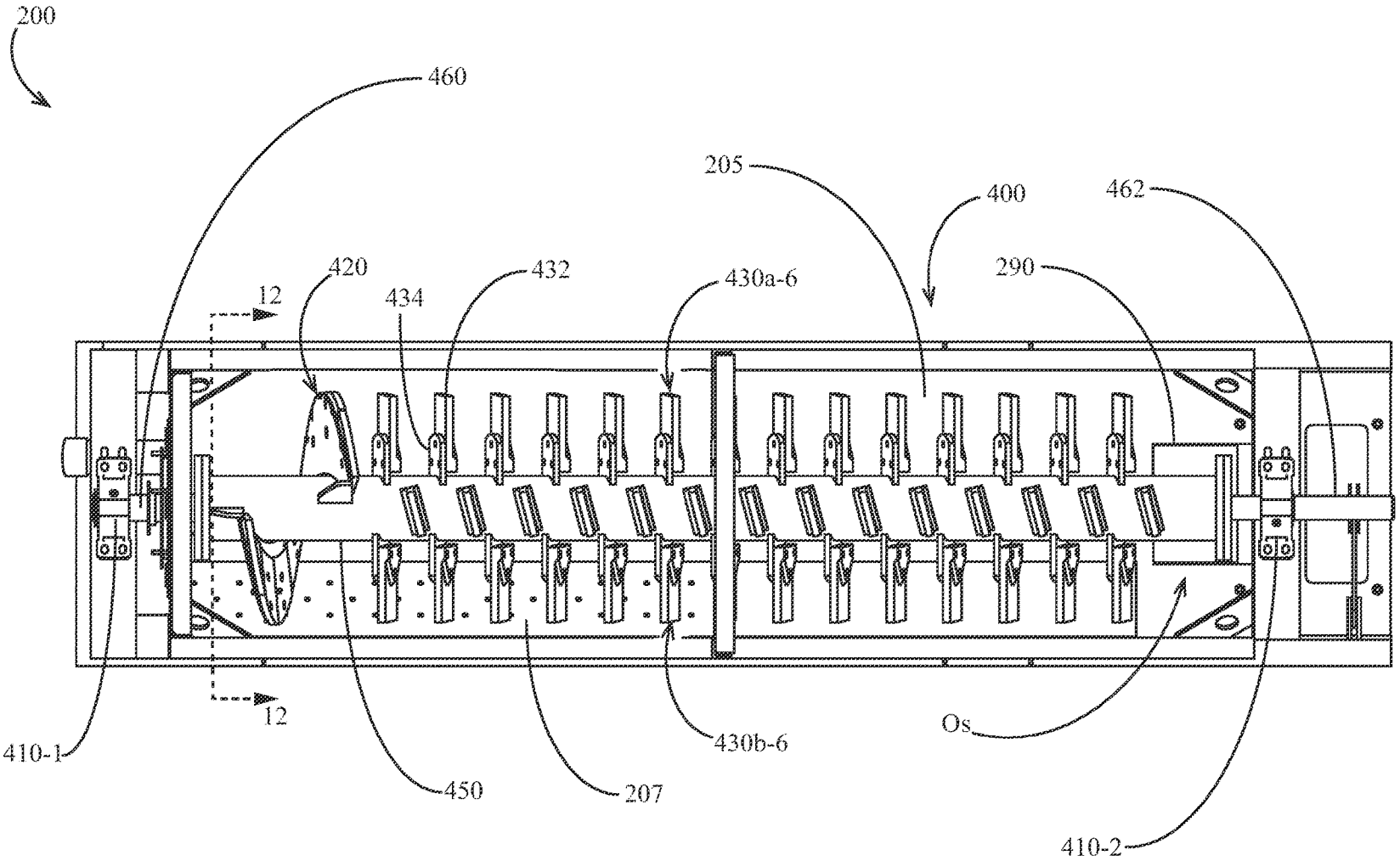
FIG. 7 is a plan view of an embodiment of a slurrying mechanism.

With reference to FIGS. 6 and 7, the propulsion assembly 400 optionally comprises a shaft 450 (e.g., a hollow metal cylinder) extending generally along the length of the slurrying mechanism 200. The shaft 450 is optionally rotatably supported at forward and rearward ends of the tub 201, e.g., by bearings 410-1 and 410-2, respectively. The shaft 450 is optionally rigidly mounted at rearward and forward ends thereof to shafts 460, 462, respectively, which optionally have smaller radii than the shaft 450. The shafts 460, 462 are optionally rotatably supported by the bearings 410-1, 410-2, respectively. The shaft 460 optionally extends through and is optionally supported in the rear wall 206, e.g., by an opening and/or bearing structure supported by the rear wall 206. The propulsion assembly (e.g., the shaft 462 thereof) optionally extends through a notch N formed in the forward wall 208; the notch N optionally includes a lower edge 209 which is optionally positioned below the shaft 462. One or more of the shafts 460, 462 (e.g., forward shaft 462) optionally includes a driving feature (e.g., a hole, flat or slot formed therein) for engaging a drive element. A flange 470-1 is optionally concentrically mounted (e.g., by welding) to a forward end of shaft 460. The flange 470-1 is optionally removably mounted (e.g., by bolts) to a flange 470-2, which is optionally concentrically mounted (e.g., by welding) to a rearward end of shaft 450.

A flange 470-3 is optionally concentrically mounted (e.g., by welding) to a forward end of shaft 450. The flange 470-3 is optionally removably mounted (e.g., by bolts) to a flange 470-4, which is optionally concentrically mounted (e.g., by welding) to a rearward end of shaft 462.

One or more augers 420 are optionally mounted along the length of the shaft 450, e.g., at the rearward end of the shaft as illustrated. The auger 420 is optionally disposed to propel water, aggregate materials and/or slurry in a generally forward direction. Each auger 420 optionally comprises an auger blade 422 which may be mounted (e.g., by welding) to the shaft 450. Each auger blade 422 may comprise one or more auger flights which are optionally arranged helically about the circumferential surface of the shaft 450. One or more wear pads 424 (e.g., flat pads which may be made of urethane, rubber, steel or another material) are optionally fixed to the auger blade 422 (e.g., to a forward surface thereof). The wear pads 424 may be mounted by bolts using openings 425 which may be provided in the auger blade 422. Gussets 421, 423 are optionally welded to the shaft 450 and to the auger blade 422 in order to reinforce the shape of the auger blade and/or the connection of the auger blade to the shaft 450.

One or more paddle assemblies 430, 440 are optionally provided along the length of the shaft. In the illustrated embodiment, fourteen paddle assemblies 430, 440 are provided along the length of the shaft. The paddle assemblies are optionally disposed to propel aggregate materials and/or slurry in an agitative manner (e.g., so as to stir the aggregate materials and water into a slurry). Each paddle assembly 430 optionally comprises a mounting base 434 which may be made of metal such as steel and mounted (e.g., by welding) to the shaft 450. Each paddle assembly 430 optionally comprises a paddle 432 (e.g., having a generally rectangular profile as illustrated or other profile) extending radially from the shaft 450 and optionally removably mounted (e.g., by bolts) to the mounting base 434. Each paddle assembly 440 optionally comprises a mounting base 444 which may be made of metal such as steel and mounted (e.g., by welding) to the shaft 450. Each paddle assembly 440 optionally comprises a paddle 442 (e.g., having a generally rectangular profile as illustrated or other profile) extending radially from the shaft 450 and optionally removably mounted (e.g., by bolts) to the mounting base 444. The paddles 432, 442 may be made of metal, urethane or other materials; the paddles may also comprise a metal (e.g., steel) core which may be cast in urethane, rubber or other materials. In other embodiments the paddles may be mounted (e.g., by welding or bolting) directly to the shaft 450. Pairs of paddle assemblies 430*a*, 430*b* may be mounted to the shaft 450 at approximately the same axial positions along the shaft on generally opposing sides of the shaft. Pairs of paddle assemblies 440*a*, 440*b* may be mounted to the shaft 450 at approximately the same axial positions along the shaft on generally opposing sides of the shaft. The paddle assemblies 430*a*, 430*b* may be axially offset from the nearest adjacent paddle assemblies 440*a*, 440*b* as illustrated, or may be axially aligned with an adjacent but angularly offset paddle assembly in other embodiments. The paddle assemblies 430*a*, 430*b* may be angularly offset from paddle assemblies 440*a*, 440*b* (e.g., by 90 degrees as illustrated or by an acute or obtuse angle in other embodiments).

The paddles 430, 440 may additionally be angled (e.g., as illustrated) with respect to a plane normal to the shaft axis, e.g., such that the paddles tend to drive material in a specific direction (e.g., generally forward along a direction parallel to shaft 450). It should be appreciated that in the illustrated embodiment, the propulsion assembly 400 optionally rotates counterclockwise when viewed from the rear (e.g., along the view of FIG. 5).

A motor 280 (e.g., an electric motor such as a 15 horsepower electric motor) optionally drives the propulsion assembly 400 for rotation about the shaft 450 in order to slurrify (e.g., mix, stir) the water and materials into a slurry. The motor 280 may be mounted to the slurrying mechanism. A drive assembly 286 may include a belt or other mechanism for transmitting power from the motor 280 to rotate the shaft 400.

It should be appreciated that during operation of the slurrying mechanism 200, materials processed by the slurrying mechanism (e.g., aggregate materials, water, and/or slurry) are optionally transferred to the dewatering mechanism 300. In the illustrated embodiment, optionally materials processed by the slurrying mechanism 200 are only transferred to (e.g., directly deposited into) the dewatering mechanism 300. In other words, the slurrying mechanism optionally exclusively transfers the processed materials (e.g., slurry) to the dewatering mechanism. In the illustrated embodiment, the walls of the slurrying mechanism 200 optionally cooperate to retain slurry in the tub 201 of the slurrying mechanism such that water introduced into the slurrying mechanism is directed (and optionally substantially and/or exclusively directed) to the dewatering mechanism 300 (e.g., through the outlet Os.) In normal operation, the slurrying mechanism 200 optionally prevents water from escaping the tub 201 (e.g., by preventing overflow of the sidewalls thereof) other than through the outlet Os. For example, the upper edges of the walls of the tub 201 (e.g., sidewalls, forward and rearward walls) are optionally disposed higher than the outlet Os such that as the tub 201 fills, material and/or water exits the outlet Os before the tub can fill beyond the upper edge of any wall of the tub. The tub (e.g., the rearward wall and/or rearward ends of the sidewalls of slurrying mechanism 200) is optionally free of any weir or other overflow wall and/or channel. In alternative embodiments, a portion of the materials (e.g., water carrying fine materials) may be transmitted to other locations (e.g., other than the dewatering mechanism) external to the dewatering mechanism (e.g., by overflowing a weir or other barrier).

Figure 13:
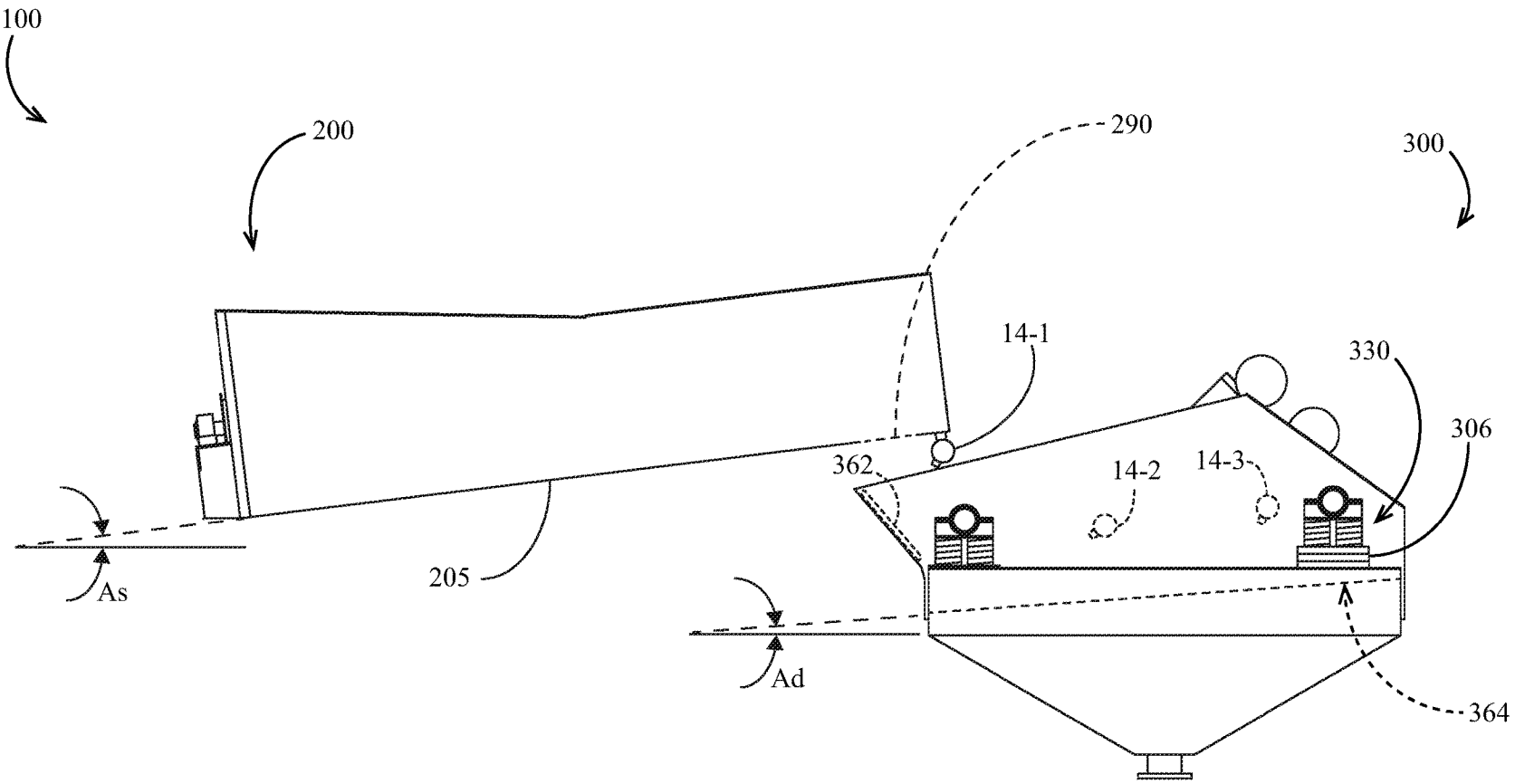
FIG. 13 is a schematic side elevation view of an embodiment of an aggregate washing system.

Referring to FIG. 13, it should be appreciated that the incline angle As of the slurrying mechanism 200 (e.g., the floor 205 thereof) determines operational characteristics of the slurrying mechanism such as the processing time and slurrying effectiveness. In various embodiments, the incline angle As is 0 degrees, between 0 and 20 degrees, between 0 and 10 degrees, between 2 and 5 degrees, between 3 and 5 degrees, between 4 and 5 degrees, between 2 and 3 degrees, between 2 and 4 degrees, 2 degrees, approximately 2 degrees, 3 degrees, approximately 3 degrees, 4 degrees, approximately 4 degrees, 5 degrees, and approximately 5 degrees. The incline angle As is optionally adjustable; in the illustrated embodiment the adjustment of incline angle As is accomplished by use of the angle adjustment system 500 described herein. In other embodiments, the modification of angle As may be accomplished by lifting or lowering the forward and/or rearward end of the slurrying mechanism 200 (e.g., by attaching lift equipment such as lift jacks or power implements, which may be connected to lift structure provided on the tub 201); in such embodiments, shims and/or other external structure may be used to retain the tub 201 at the modified incline angle As.

Figure 1:
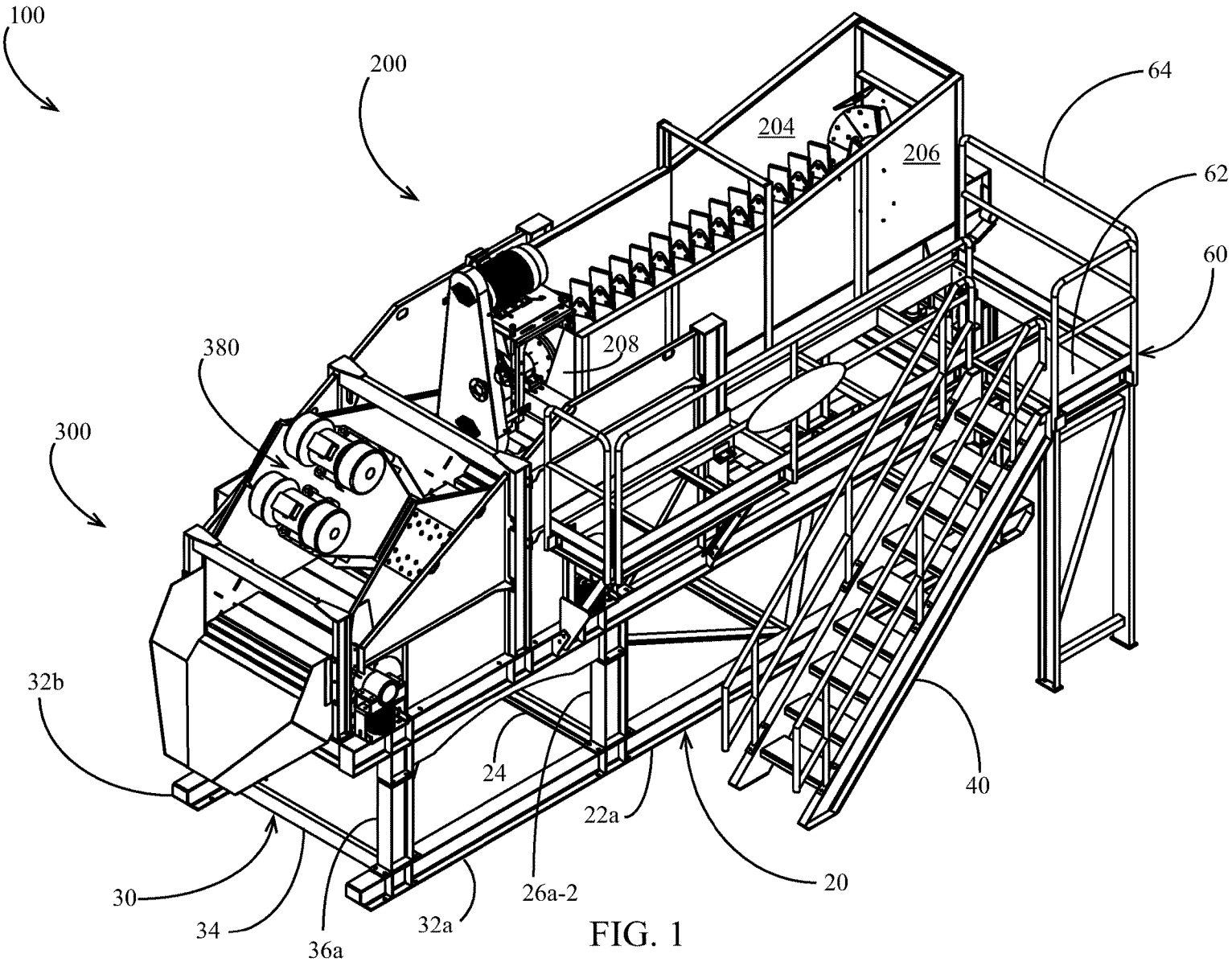
FIG. 1 is a perspective view of an embodiment of an aggregate washing system.
Figure 2:
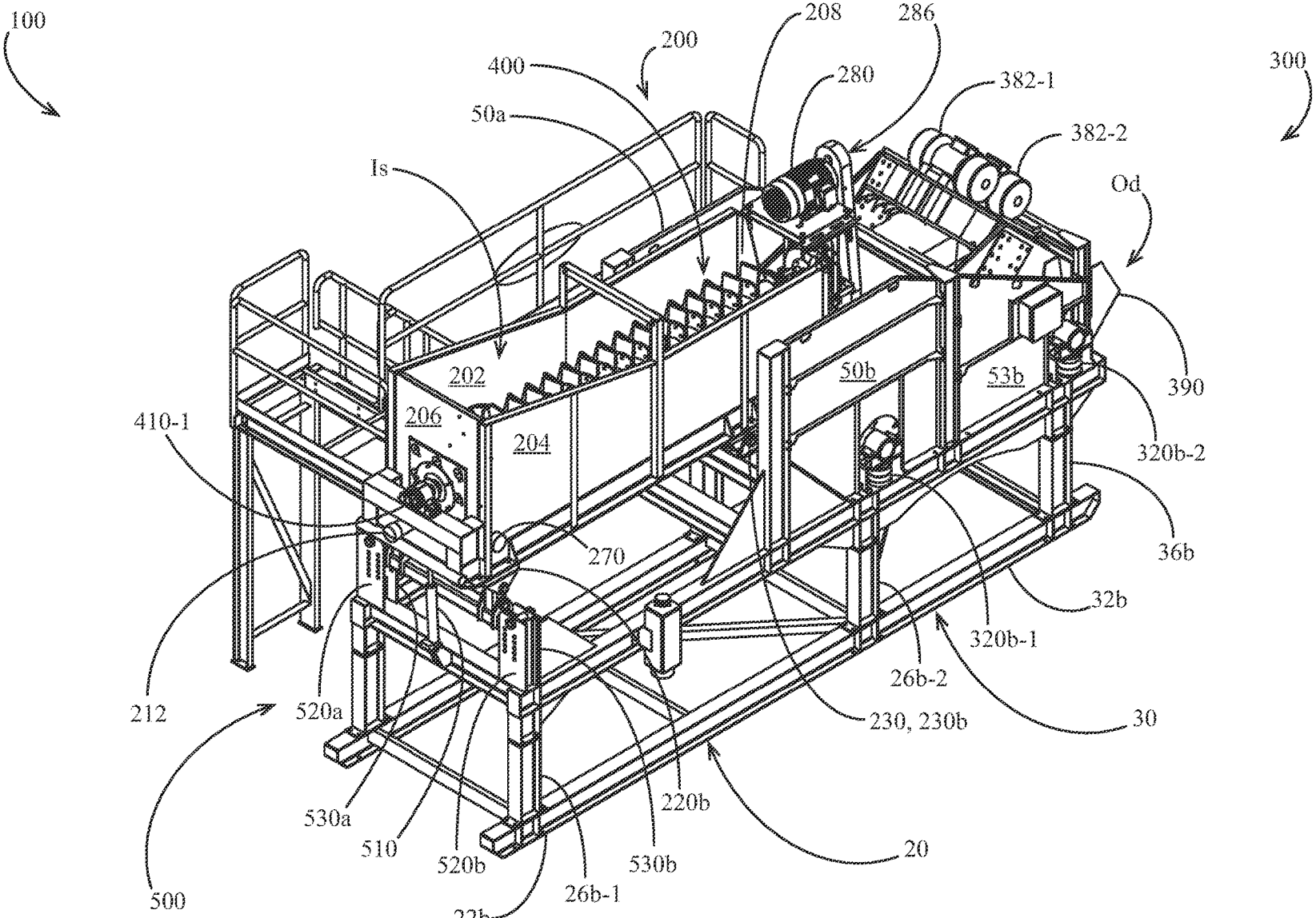
FIG. 2 is another perspective view of the aggregate washing system of FIG. 1.
Figure 3:
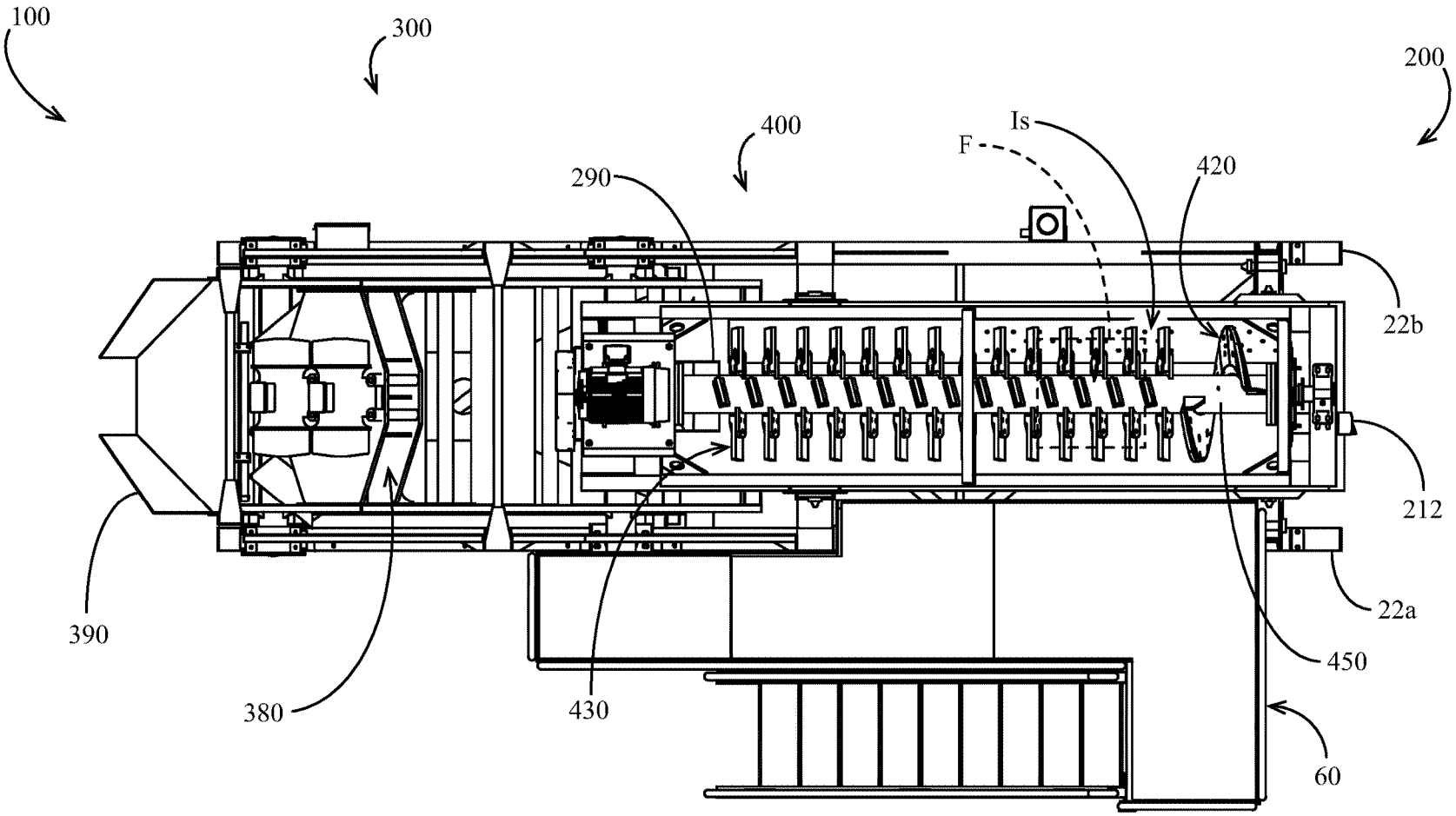
FIG. 3 is a plan view of the aggregate washing system of FIG. 1.
Figure 4:
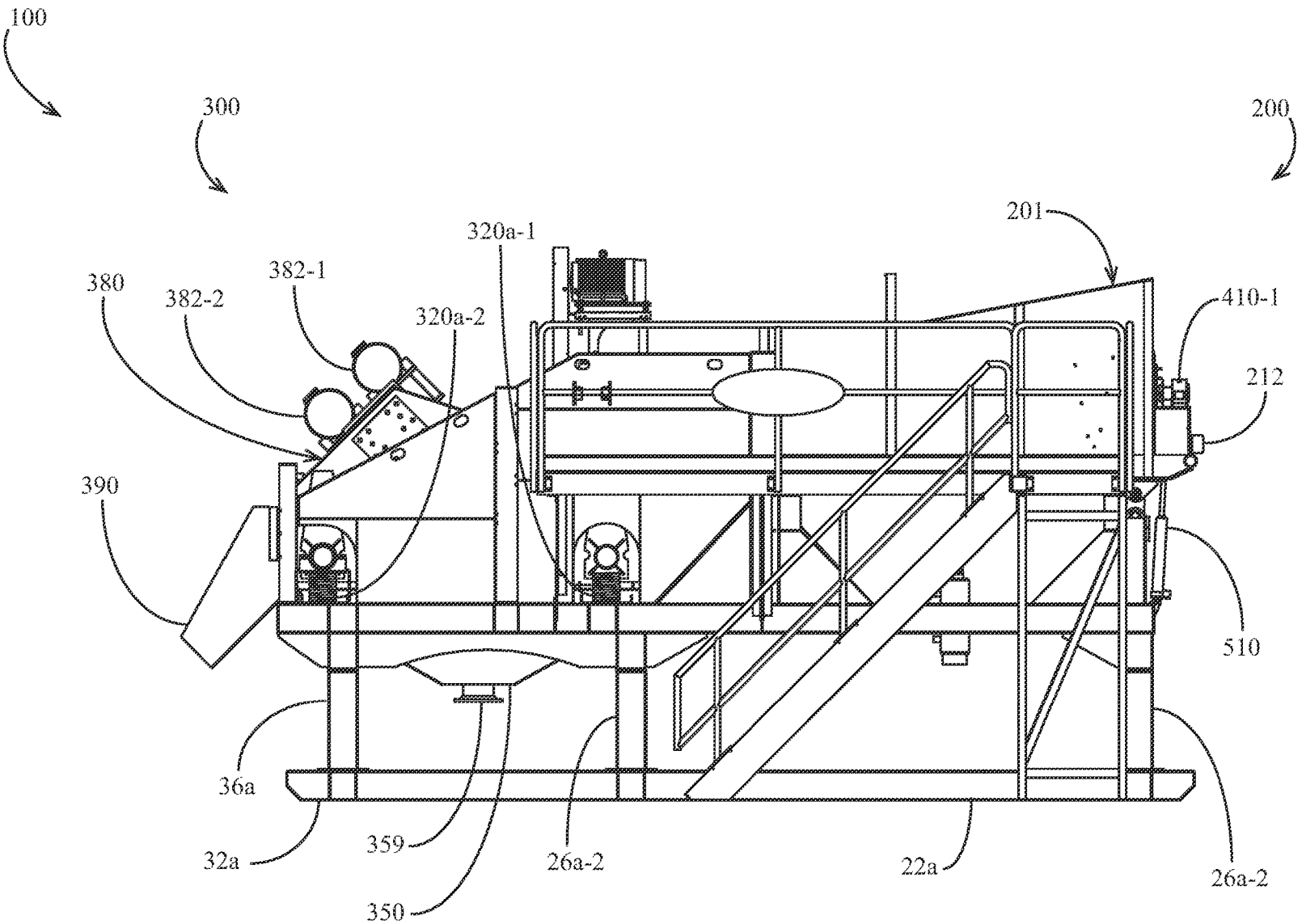
FIG. 4 is a side elevation view of the aggregate washing system of FIG. 1.
Figure 5:
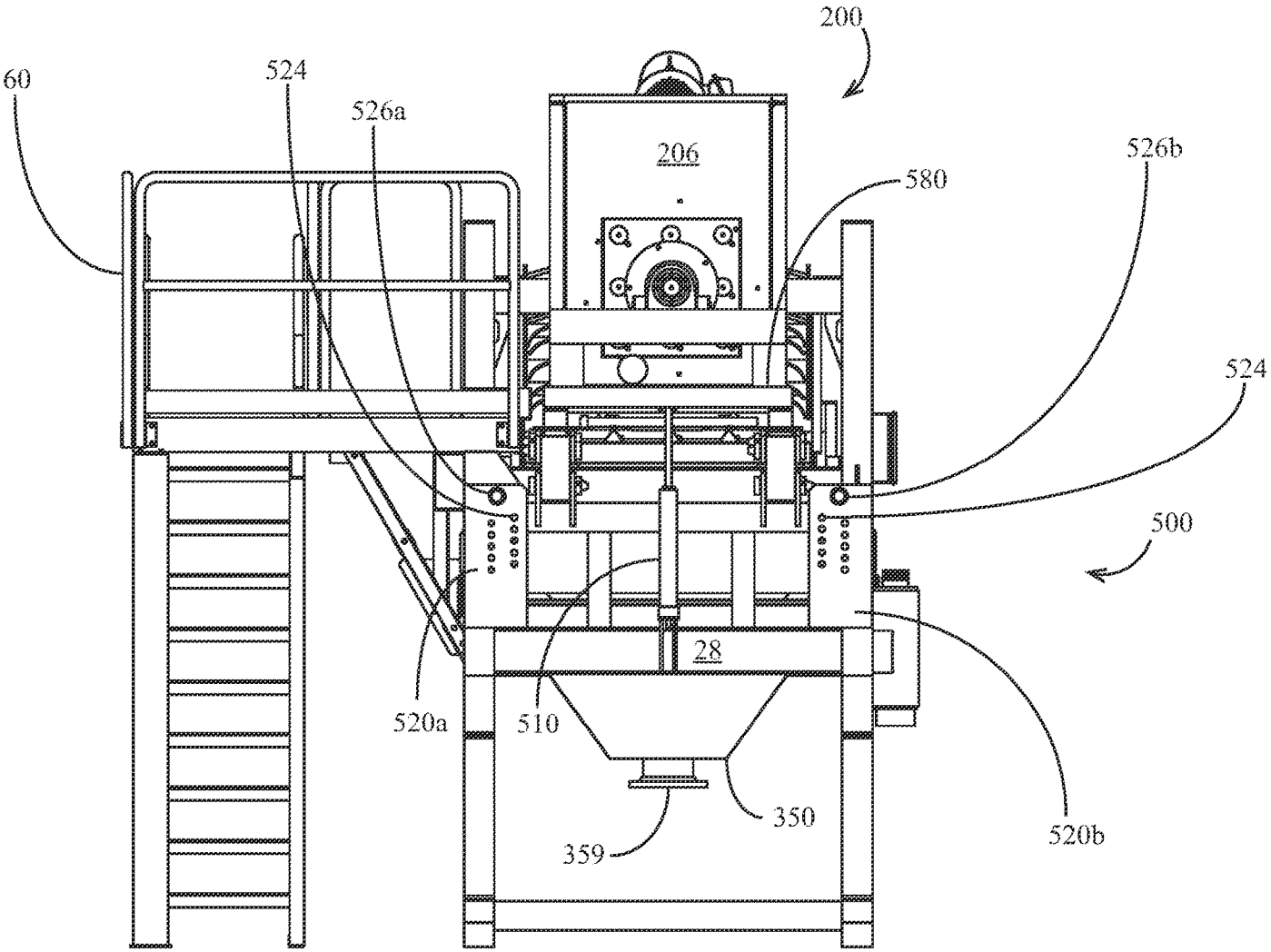
FIG. 5 is a rear elevation view of the aggregate washing system of FIG. 1.

As may be seen in FIG. 2, the slurrying mechanism 200 is optionally supported on a pivot 230 which may comprise a left pivot 230*a* (not shown in FIG. 2) and a right pivot 230*b*. The pivot 230 may comprise a pivot bracket or pivot brackets mounted to and supported by (e.g., welded to) the frame 20. The pivot 230 optionally defines a generally transverse pivot axis about which the slurrying mechanism 200 may be pivoted in order to modify the incline angle As. The pivot 230 is optionally mounted to (e.g., welded to) a lower portion of the slurrying mechanism 200. The pivot 230 is optionally disposed forward of a center of gravity of the slurrying mechanism 200 as illustrated, although in other embodiments the pivot may be disposed at any location along the length of the slurrying mechanism. In other embodiments the pivot 230 omitted; in some such embodiments, the slurrying and dewatering mechanisms are optionally rigidly mounted to one another and may be either mobile or fixed, while in other such embodiments, the slurrying and dewatering mechanisms are optionally unconnected and may be either mobile or fixed.

In some embodiments, in order to enable selective adjustment of the incline angle As (e.g., by pivoting the slurrying mechanism 200 about the pivot 230), an incline adjustment mechanism 500 is optionally provided for selecting the vertical position of one end (e.g., the rearward end) of the slurrying mechanism. The incline adjustment mechanism 500 optionally includes one or more selectively vertically positionable supports for supporting a portion of the slurrying mechanism 200 at various heights. The incline adjustment mechanism 500 may optionally include an actuator 510 for moving (e.g., raising and/or lowering) the portion (e.g., the rearward end) of the slurrying mechanism 200 to various heights; however, in some implementations the portion of the slurrying mechanism may be raised and lowered using other equipment. For example, in the embodiment shown in FIG. 15, the height of footing 1017 may be determined by a supporting structure positioned underneath the footing.

Figure 8:
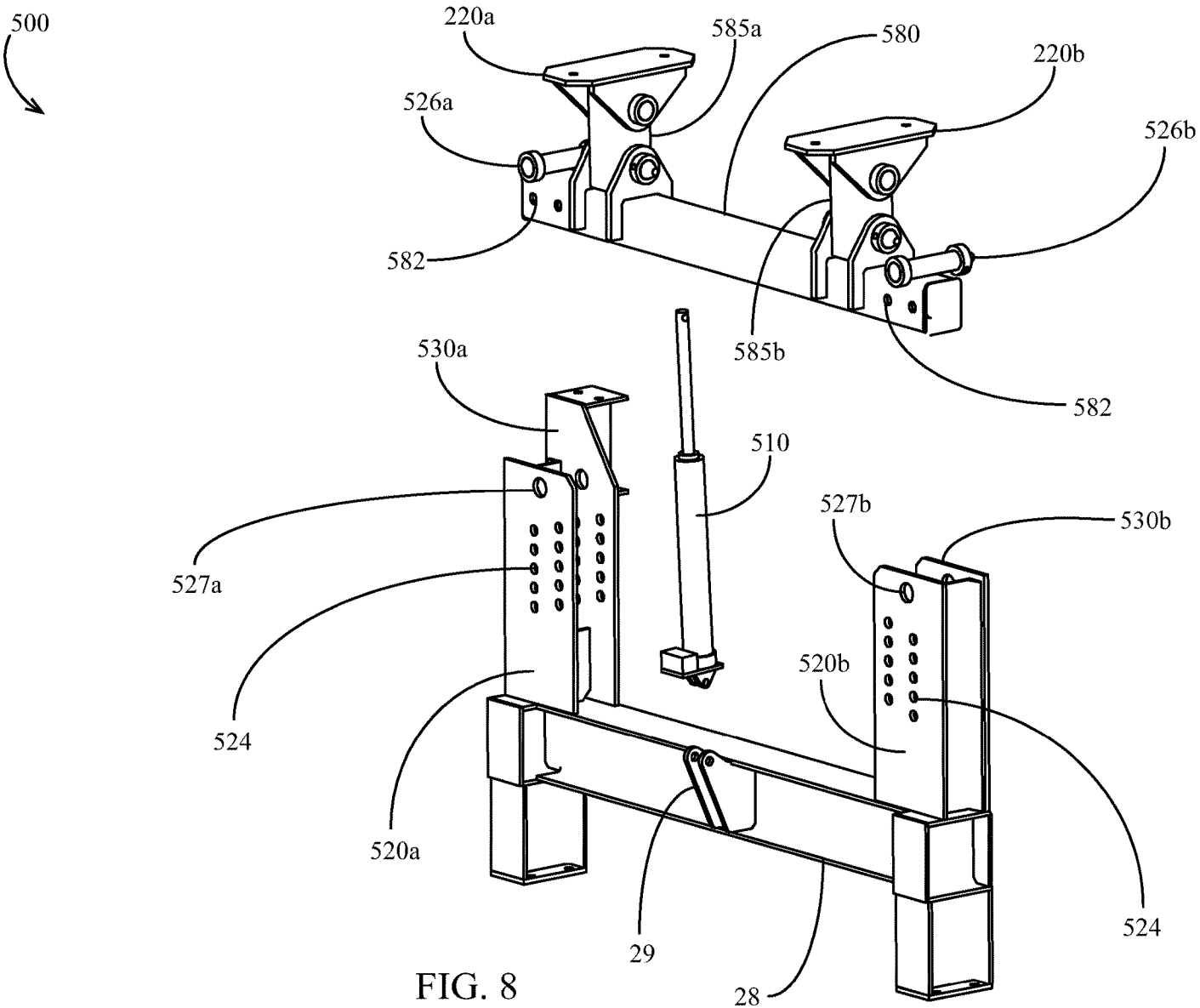
FIG. 8 is an exploded view of an embodiment of an incline adjustment assembly.

With reference to FIG. 8, the incline adjustment mechanism 500 comprises rearward and forward left support plates 520*a*, 530*a* respectively and rearward and forward right support plates 520*b*, 530*b* respectively. The support plates 520, 530 may be supported by the frame 20, e.g., by being welded to a cross beam 28. The support plates 520, 530 optionally each include a plurality of holes 524 disposed in vertically spaced relation. Each hole 524 in each rearward support plate 520 is optionally longitudinally aligned with a hole in the corresponding forward support plate 530 (e.g., such that a pin may extend through and be supported in both holes simultaneously). A transversely extending support bar 580 optionally pivotally supports the rearward end of the slurrying mechanism 200. In the illustrated embodiment, left and right upwardly extending bars 585*a*, 585*b*, respectively, optionally pivotally support left and right brackets 220*a*, 220*b*, respectively. The brackets 220 are optionally mounted (e.g., by welding) to the slurrying mechanism 200. A leftward portion of the bar 580 is optionally received between the left support plates 520*a*, 530*a*. A rightward portion of the bar 580 is optionally received between the right support plates 520*b*, 530*b*. With the bar 580 in a given selected vertical position, a support pin (not shown) is optionally placed in one or more of the paired holes 524 in the left and right support plates in order to support and/or retain the bar 580 in the selected vertical position and thus retain the selected incline angle As of the slurrying mechanism 200. The support pins (not shown) may be placed through holes 524 below and above the bar 580. Alternatively or additionally, one or more support pins may be extended through a hole 524 in a rearward plate 520, further extended through a hole 582 in the bar 580, and further extended through a corresponding hole 524 in a forward plate 530, such that the bar 580 is supported in position relative to the support plates 520, 530 by the support pin.

In addition to the support pin, stop pins 526*a*, 526*b* may be removably inserted into upper openings 527*a*, 527*b* respectively in order to provide an upper stop restricting the bar 580 from being retracted from between the support plates 520, 530.

In embodiments including an actuator 510 for raising and/or lowering the slurrying mechanism 200, the actuator 510 is optionally pivotally coupled to the frame 20 (e.g., by pin connection to a bracket 29 which may be mounted to the cross beam 28). The actuator 510 is optionally pivotally coupled to the bar 580. The actuator 510 optionally comprises a hydraulic dual-acting actuator which may be extended or retracted in order to raise or lower the bar 580 and thus modify the incline angle As.

Dewatering Mechanism Embodiments

In some embodiments, the dewatering mechanisms described herein optionally not only remove water from the processed materials but additionally separate contaminants (e.g., dirt, fines) from the materials and remove the contaminants along with the removed water. Thus in some embodiments, the dewatering mechanism may also be described as a washing mechanism or a washing and dewatering mechanism.

An embodiment of a dewatering mechanism comprising a vibrating screen is described in more detail below. However, it should be appreciated that in other embodiments the dewatering mechanism may alternatively or additionally comprise a sand screw, a cyclone, a press, or another device for removing water and/or contaminants or fines from the material being processed.

Figure 9:
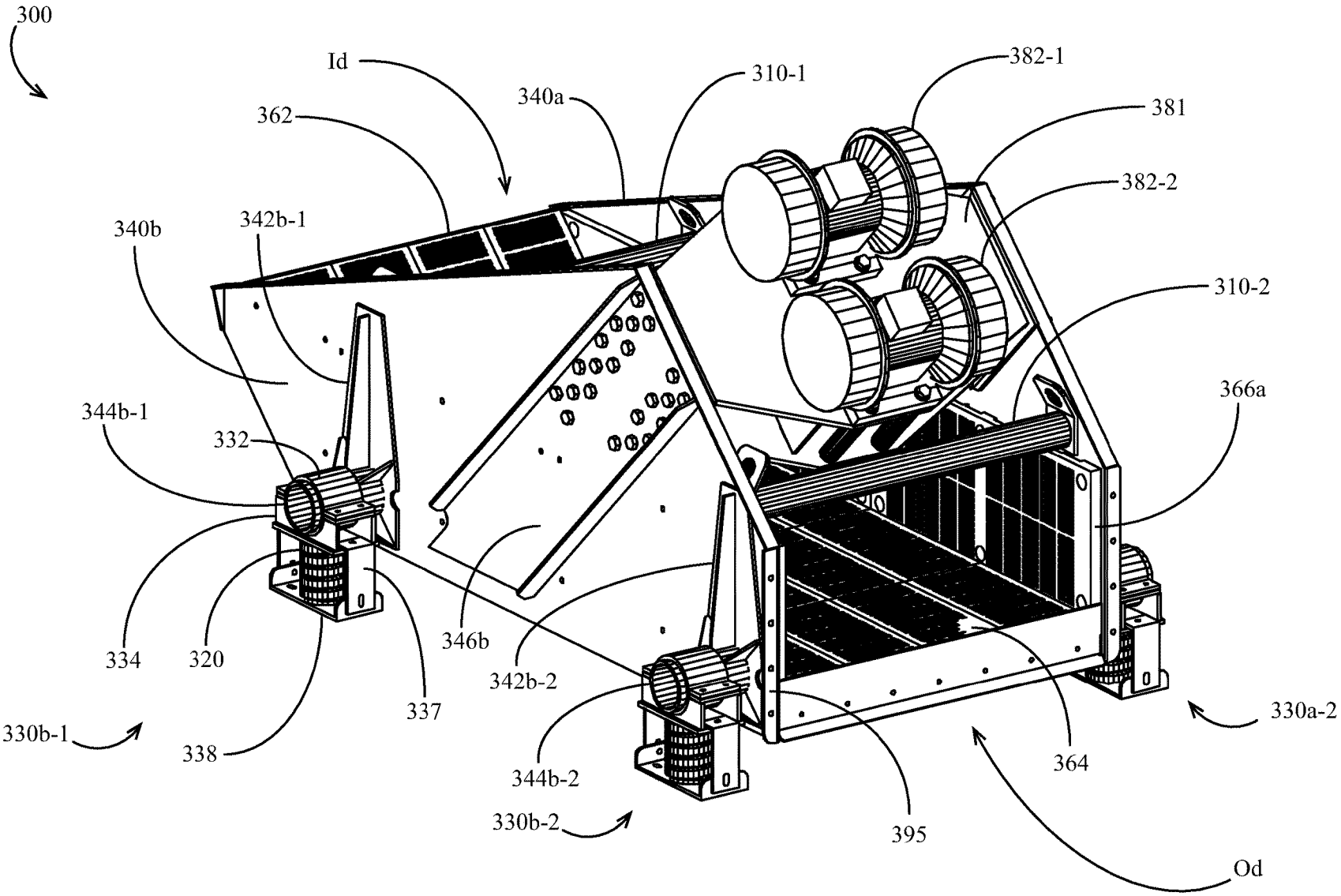
FIG. 9 is a perspective view of an embodiment of a dewatering mechanism.
Figure 10:
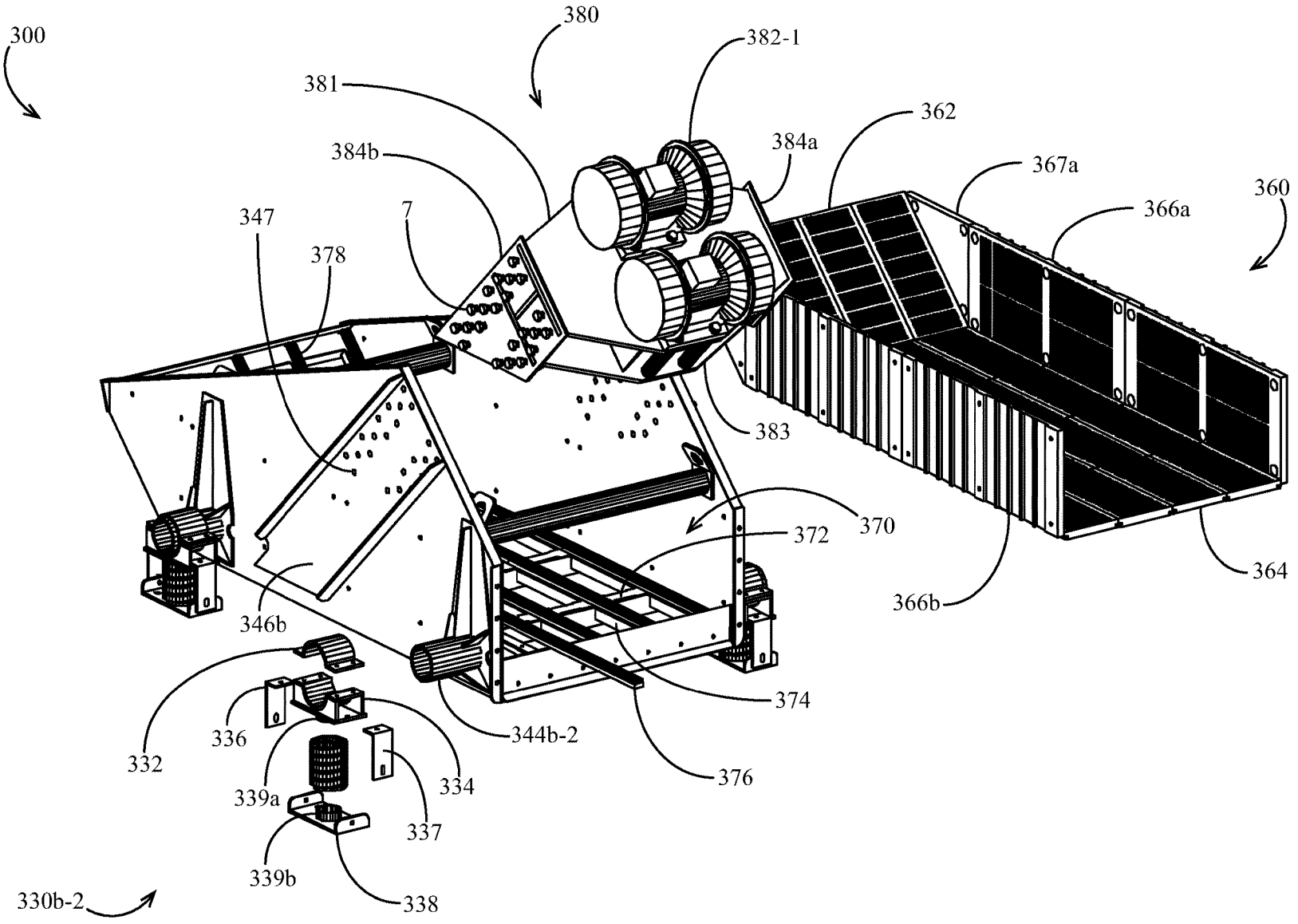
FIG. 10 is a partially disassembled view of the dewatering mechanism of FIG. 9.
Figure 11:
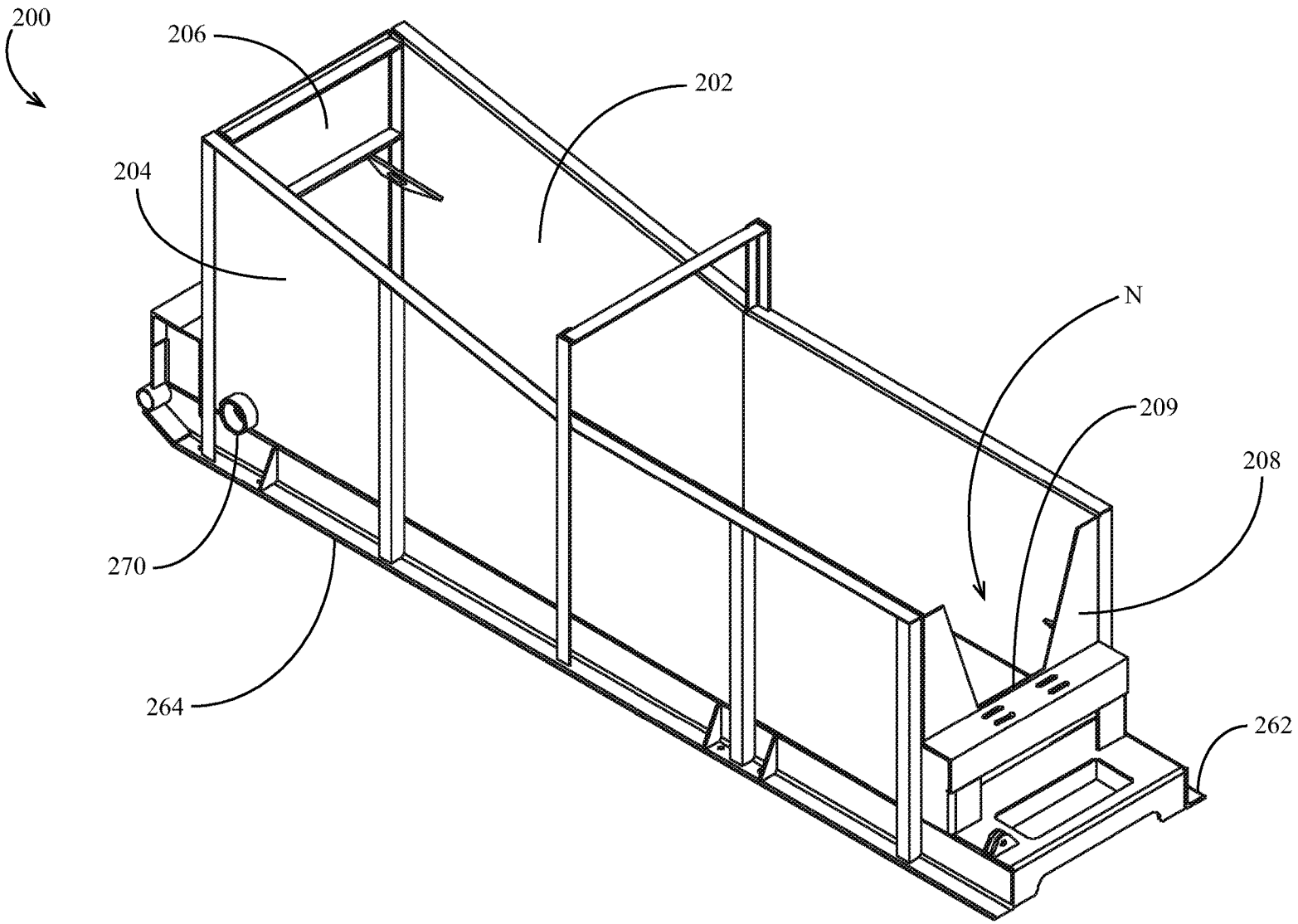
FIG. 11 is a perspective view of an embodiment of a tub of the slurrying mechanism of FIG. 7.
Figure 12:
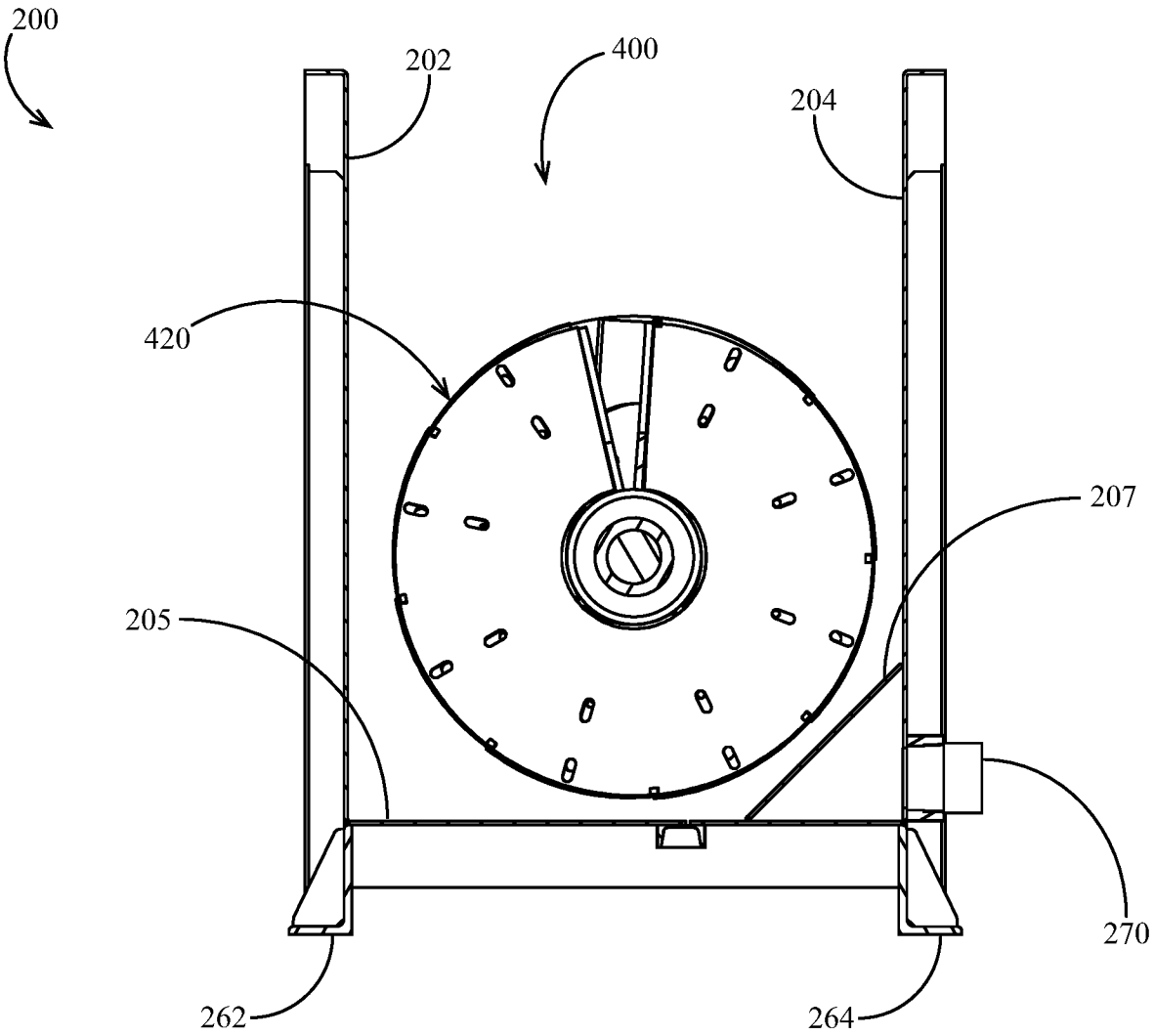
FIG. 12 is a cross-sectional view of the tub of FIG. 11 along the section 12-12 of FIG. 7.

Referring to FIGS. 9 and 10, the dewatering mechanism 300 optionally generally comprises a vibrating screen including one or more decks of screen media. The dewatering mechanism 300 optionally generally comprises a pair of sidewalls 340*a*, 340*b* transversely connected by one or more support bars 310 and a floor frame 370 which optionally supports a screen media deck 360.

The dewatering mechanism 300 is optionally resiliently supported on a spring suspension comprising a plurality of spring assemblies 330. In the illustrated embodiment, a rearward pair of spring assemblies 330*a*-1, 330*b*-1 resiliently supports a rearward end of the dewatering mechanism 300 and a forward pair of spring assemblies 330*a*-2, 330*b*-2 resiliently supports a forward end of the dewatering mechanism 300. Each spring assembly 330 optionally comprises a spring 320 disposed to be compressed by the weight of the dewatering mechanism 300 (e.g., generally vertically oriented).

The spring 320 is optionally retained in its orientation at an upper end thereof by an annular ring 339*a* disposed inside an upper end of the spring and mounted to an upper bracket 334. The upper bracket 334 is optionally releasably mounted to a transversely extending axle 344, e.g., by fastening a cap portion 332 over the axle 344 onto the upper bracket 334. When fastened together, the upper and lower bracket optionally comprise a bearing in which the axle 344 is retained. Each axle 344 is optionally mounted to the associated sidewall 340, optionally by being mounted (e.g., by welding) to a gusset plate 342 which is optionally mounted (e.g., by welding) to the sidewall 340.

The spring 320 is optionally retained in its orientation at a lower end thereof by an annular ring 339*b* disposed inside a lower end of the spring and mounted to a lower bracket 338. The lower bracket 338 is optionally mounted to (e.g., welded to or bolted to) the frame 30. Side brackets 336, 337 are optionally mounted (e.g., by bolting) at an upper end to the upper bracket 334. Side brackets 336, 337 are each optionally slidingly engaged to the lower bracket 338 (e.g., by engagement of a slot on the side bracket with a post on the lower bracket) such that the upper and lower brackets are enabled to deflect relative to one another as the spring 320 is compressed and decompressed due to vibration of the dewatering mechanism 300.

The dewatering mechanism 300 is optionally driven for vibration by one or more motors 382 (e.g., a pair of motors 382-1, 382-2 as illustrated). The motors 382 optionally drive eccentric weights such that the motors and the remainder of the mechanism 300 are vibrated in a repeated pattern which may include vertical and/or horizontal movement (e.g., circular motion, elliptical motion, linear vertical movement, linear inclined movement). In the illustrated embodiment, the motors 382 are mounted to a motor mount frame 380 which includes a transversely extending plate 381 to which the motors are rigidly attached (e.g., by bolts). The plate 381 optionally extends between and is supported (e.g., directly or indirectly) on the sidewalls 340. The motor mount frame 380 optionally includes transversely spaced left and right side plates 384*a*, 384*b*. The plate 381 (and optionally one or more additional strengthening plates 383) optionally extends transversely between and are optionally supported by the side plates 384. The side plates are optionally mounted to the sidewalls 340 by attaching bolts 7 through openings 347 provided in each sidewall. The openings 347 and bolts 7 optionally additionally extend through a gusset plate 346 mounted (e.g., by welding) to the sidewall 340.

The screen media deck 360 optionally comprises floor screen media panels 364 which optionally form a lower surface of the screen media deck. The screen media panels 364 are optionally disposed parallel to and optionally adjacent to a bottom of the dewatering mechanism 300. Each screen media panel described herein optionally comprise a screen having openings sized to allow water and/or fine materials to pass through the panel 364 into an underflume 350 having a lower opening 359 through which water and/or fine materials may be drained for storage or further processing. Each screen media panel described herein may be made of any material (e.g., urethane, rubber, polyurethane, plastic, cloth). In various embodiments, the screen media are installed using pins or tensioning hooks. In other embodiments, the screen media panels may be snapped in place and may comprise SnapDeck® screen media panels available from Weir Group of Glasgow, Scotland. The screen media panels optionally have an array of openings sized for removal of water and contaminants without allowing oversize materials (e.g., sand) to pass through. In various embodiments the panel openings may have a width of various dimensions such as between 0.1 millimeters and 1 millimeter, between 0.25 and 0.5 millimeters, approximately 0.25 millimeters, approximately 0.5 millimeters, 0.25 millimeters or 0.5 millimeters. In various embodiments the panel openings may have a length of between 1 and 20 millimeters, approximately 10 millimeters, approximately 15 millimeters, between 10 and 15 millimeters, 10 millimeters, 11 millimeters, 12 millimeters, 13 millimeters, 14 millimeters, or 15 millimeters.

The screen media deck 360 optionally comprises left and right side screen media panels 366*a*, 366*b* substantially similar to the panels 364 and disposed along the interior of sidewalls 340. Water and/or fine materials passing through the side screen media panels 366 during operation optionally pass downward between the sidewalls 340 and the panels 366 to the underflume 350, e.g., through vertically-oriented channels formed in the panels 366.

The screen media deck 360 optionally comprises incline screen media panels 362 substantially similar to the panels 364 and disposed along the inclined rearward portion of the floor. Water and/or fine materials passing through the side screen media panels 366 during operation optionally pass downward through the panels 362 to the underflume 350. Side panels 367*a*, 367*b* (e.g., removable urethane panels) are optionally disposed along the sidewalls between the side screen media panels 366 and the incline screen media panels 362.

The floor frame 370 optionally extends from a rearward end of the mechanism 300 to a forward end of the mechanism 300. The floor frame 370 optionally comprises a lower forward portion supporting floor screen media panels 364. The floor frame 370 optionally comprises a rear inclined portion supporting inclined screen media panels 362. The floor frame 370 optionally comprises a plurality of crossbeams 372 and generally longitudinally extending beams 374. Deck runners 376 are optionally removably mounted (e.g., by bolting) to the longitudinally extending beams 374. Deck runners 378 may optionally be employed in the rearward portion of the deck. The deck runners 376 and/or deck runners 378 may be made of urethane or other material. The screen media panels 362, 364 are optionally mounted to the floor frame 370 by snap fitting (e.g., snap fitting to the runners 376).

A flange 395 is optionally provided at the forward end of the dewatering mechanism 300. The flange 395 optionally comprises a plurality of mounting holes arranged about to the outlet Od. A discharge chute 390 may be mounted to the flange 395 by the mounting holes in order to direct the deposition of material discharged through outlet Od by the dewatering mechanism 300.

As may be seen in the schematic view of FIG. 13, the opening 290 in the slurrying mechanism 200 is optionally disposed above the incline screen media panels 362 such that material (e.g., water, aggregate material, slurry, etc.) deposited through the opening 290 falls on the incline screen media panels 362 and then moves downwardly and forwardly under the influence of gravity and/or the vibrational motion of the dewatering mechanism. The material then advances across the floor screen media panels 364 to the outlet Os. An incline angle Ad at which the floor screen media panels 364 are generally oriented may affect operational parameters of the dewatering mechanism 300 (e.g., processing time before materials are deposited from the outlet Od, effectiveness of removal of water and/or fines). In various embodiments the incline angle Ad may be between 10 degrees above horizontal and 10 degrees below horizontal; between 5 degrees above horizontal and 5 degrees below horizontal; between 0 and 5 degrees below horizontal, between 0 and 5 degrees above horizontal; 1, 2, 3, 4 or 5 degrees above horizontal; or approximately 1, 2, 3, 4 or 5 degrees above horizontal.

In some embodiments, the incline angle Ad may be adjusted in a manufacturing phase or by an operator. In some such embodiments, an incline adjustment assembly similar to the assembly 500 may be used to raise or lower a portion of the dewatering mechanism 300 (e.g., a rearward portion thereof) relative to the frame 30 (and/or to the ground) in order to vary the incline angle Ad. In other embodiments, the incline angle Ad may be adjusted by adding or removing support structure (e.g., one or more removable shims 306) to raise or lower the spring assemblies 330. In various embodiments, the shims 306 may be inserted below the lower bracket 338 of the spring assemblies or may be inserted between the springs 320 and the lower bracket (e.g, shims having a central opening may be placed around the annular ring 339*b*).

Figure 14:
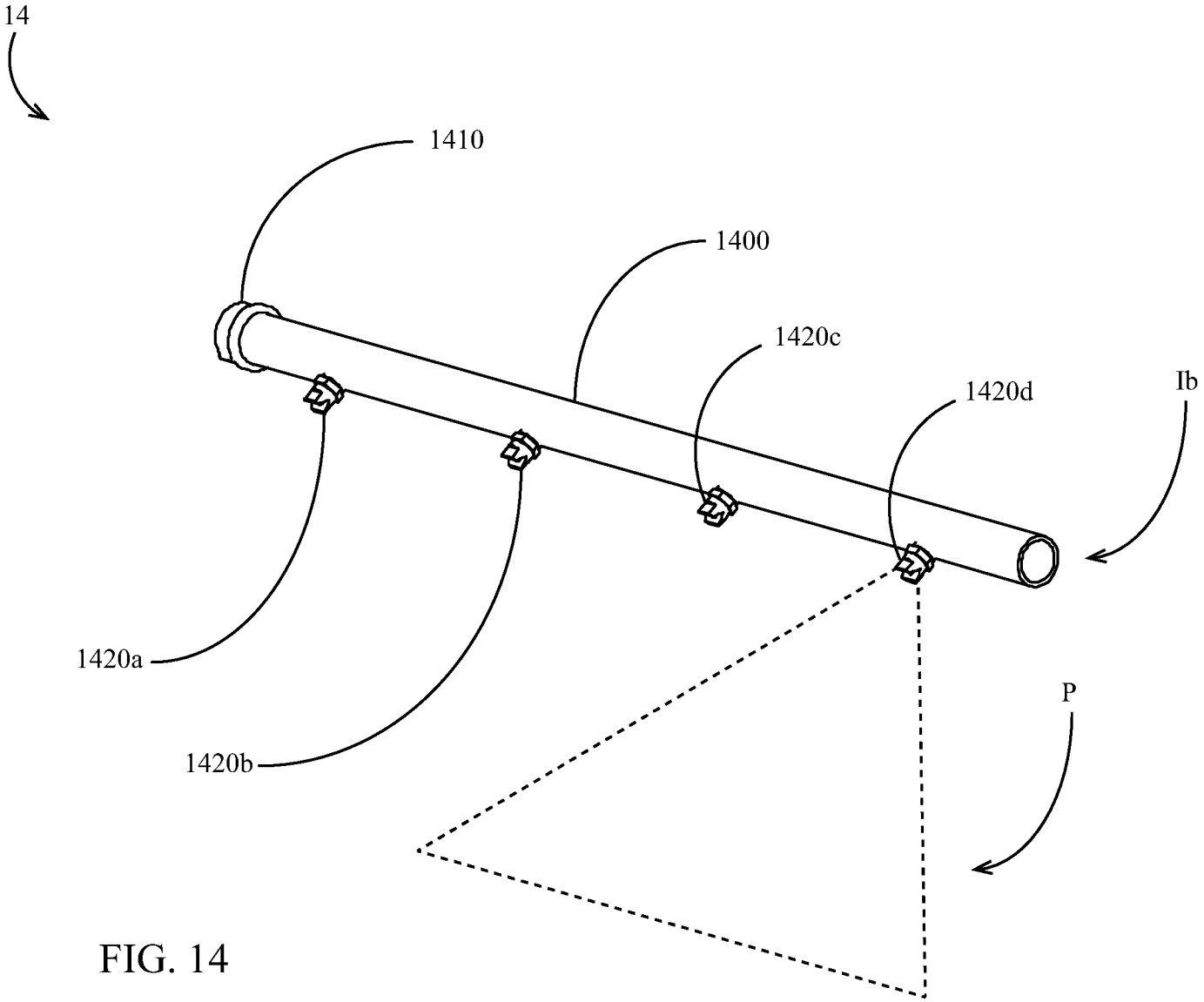
FIG. 14 is a perspective view of an embodiment of a spray bar.

In some embodiments, one or more washing elements may be used to apply fluid (e.g., pressurized water) to the materials (e.g., sand, slurry, fines) released by the slurrying mechanism 200. The washing elements may be mounted to the slurrying mechanism 200 and/or to the dewatering mechanism 300. The washing elements are optionally disposed and oriented to apply pressurized water (e.g., a spray) to materials released by the slurrying mechanism 200 and/or materials in the dewatering mechanism 300. With reference to FIGS. 13 and 14, the washing elements may comprise one or more spray bars 14. Each spray bar 14 may comprise a transversely extending plenum 1400 (e.g., a hollow tube) having an inlet Ib in fluid communication with a source of pressurized fluid (e.g., water tank or compressed air cylinder). A distal end of the spray bar 14 is optionally closed (e.g., with a cap 1410); in other embodiments, the distal end is optionally in fluid communication with another washing element and/or conduit. A plurality of spray nozzles 1420 are optionally configured to direct a spray pattern P (e.g., generally triangular spray pattern) of fluid from the plenum 1400. The plurality of spray nozzles (e.g., spray nozzles 1420*a*, 1420*b*, 1420*c*, 1420*d*) are optionally disposed along the length of the plenum 1400. The spray patterns P generated by one or more nozzles 1420 optionally at least partially overlap along a width of the dewatering mechanism 300. The spray patterns P optionally extend at least partially along a width of the deck 360.

As may be seen in FIG. 13, a plurality of washing elements (e.g., spray bars 14) may be disposed above the deck 360 and optionally extend transversely at least partially along the width of the deck 360. The nozzles of the spray bars 14 are optionally disposed to direct the associated spray pattern P having a vertical component directed generally downward toward the deck 360 and having a horizontal component directed generally rearward. A first spray bar 14-1 is optionally mounted to the slurrying mechanism 200 and disposed to spray materials exiting the opening Os (e.g., disposed generally forwardly of the opening 290) and/or materials on the incline screen media panels 362. One or more spray bars (e.g., spray bars 14-2, 14-3) are optionally disposed between the sidewalls 340 of the dewatering mechanism 300 and disposed to spray materials traversing the deck 360. One or more of the spray bars is optionally disposed to apply water to partially dewatered material which has already traversed a portion of the deck 360. It should be appreciated that application of water by a washing element (e.g., spray bar) to a dewatered and/or partially dewatered material may create a rewatered and/or partially rewatered material. Some or all of the water applied by spray bars 14-2, 14-3 is optionally removed from the at least partially rewatered material as the material moves across the remainder of the deck.

Support Structure Embodiments

As described above, in some embodiments the slurrying mechanism and/or the dewatering mechanism are supported by frames. It should be appreciated that the slurrying and/or dewatering mechanisms may be supported by other structure (e.g., a frame or surface of an existing portable and/or stationary plant) and/or positioned on the ground.

In the illustrated exemplary embodiment, frames 20, 30 respectively supporting the slurrying mechanism 200 and the dewatering mechanism 300 may comprise separate (e.g., mobile or stationary) frames or a single unitary frame. The frame 20 optionally comprises a plurality of vertical struts 26 (e.g., rearward struts 26*a*-1 and 26*b*-1, forward struts 26*a*-2 and 26*b*-2, longitudinally extending beams 22 (e.g., 22*a* and 22*b*) and optionally one or more transversely extending beams 24. The frame 30 optionally comprises a plurality of vertical struts 36 (e.g., struts 36*a* and 36*b*), longitudinally extending beams 32 (e.g., 32*a* and 32*b*) and optionally one or more transversely extending beams 34. Longitudinally extending rails 262, 264 of the slurrying mechanism 200 are optionally pivotally coupled to the frame 20. Side shields 50 (e.g., 50*a*, 50*b*) and/or side shields 53 (e.g., 53*a*, 53*b*) optionally mounted to frame 20 and/or frame 30 are optionally disposed to one or more the sides of the slurrying mechanism 200 and the dewatering mechanism 300.

It should be appreciated that optional frames supporting the slurring and/or dewatering mechanisms may be mounted to one another or separate. The frames or other support structure may be mobile (e.g., provided with wheels or tracks) or stationary.

In some embodiments, a scaffolding 60 may optionally be mounted to or positioned adjacent to the frames. The scaffolding 60 optionally support a platform 62 allowing an operator to access the slurrying mechanism 200 and/or the dewatering mechanism 300. A ladder 40 optionally allows access to the platform 62, which is optionally provided with handrails 64. The scaffolding 60 is optionally mounted to the frame 20 and/or the frame 30 (e.g., by welding) but in some embodiments may be mobile and/or independent from the frames 20, 30.

Optional Control System Embodiments

Figure 19:
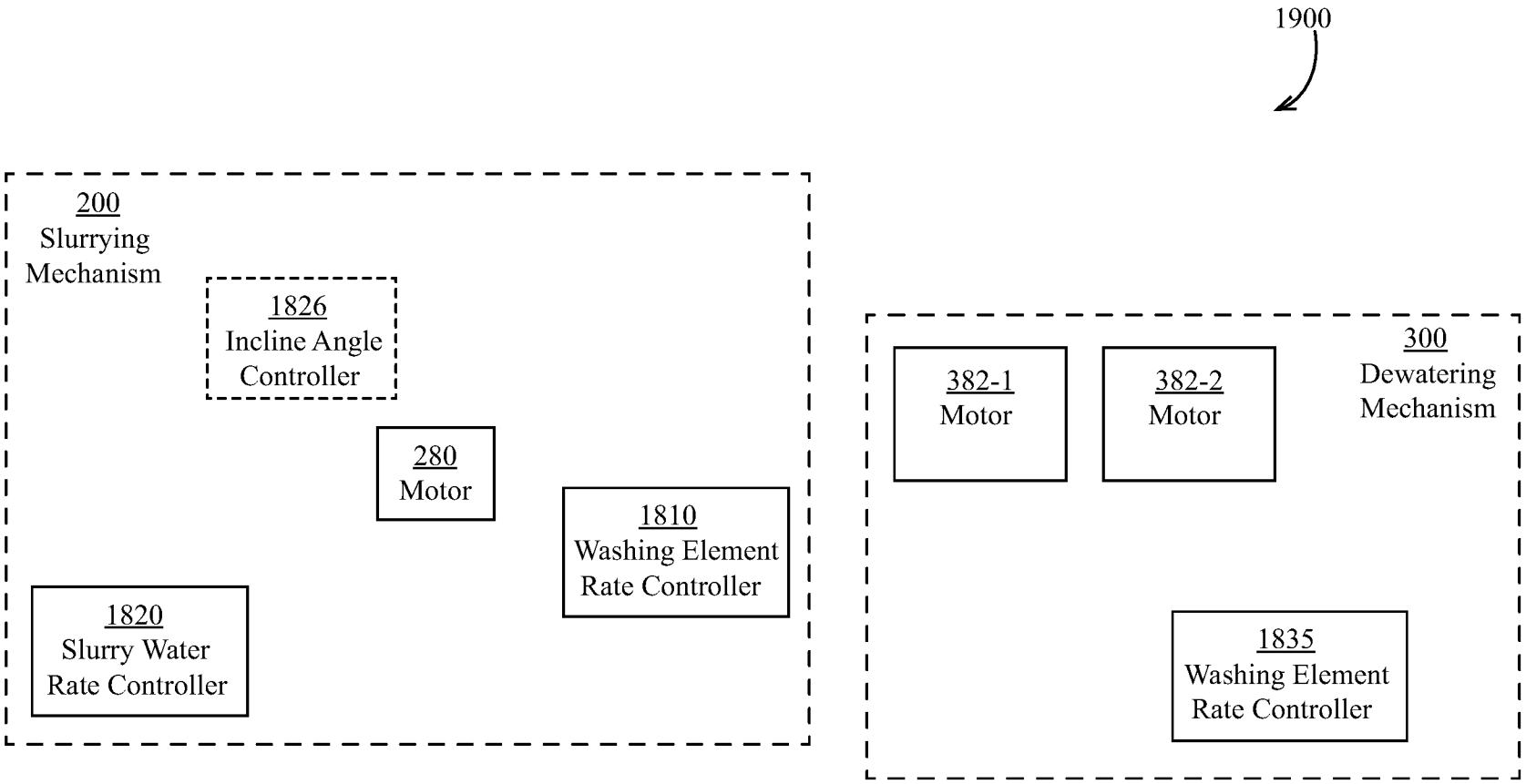
FIG. 19 schematically illustrates another embodiment of a control system for an aggregate washing system.

An optional control system 1900 for controlling the aggregate washing system 100 is schematically illustrated in FIG. 19.

In the system 1900, the motor 280 optionally operates at a variable (or in some embodiments constant) speed causing the auger blade 422 to rotate (e.g., between 200 and 400 and optionally 300 or about 300 linear feet per minute). A frequency of motors 382 may be constant or may be adjustable (e.g., by adjusting or replacing a weight rotated by the motor, or by adjusting a speed of the motor). A washing element rate controller 1810 (e.g., valve or pump) may be provided on or remote from the slurrying mechanism 200 for controlling a rate at which fluid (e.g., water) is supplied to and/or dispensed from one or more washing elements (e.g., spray bar 14-1) provided on the slurrying mechanism. A washing element rate controller 1835 (e.g., valve or pump) may be provided on or remote from the dewatering mechanism 300 for controlling a rate at which fluid (e.g., water) is supplied to and/or dispensed from one or more washing elements (e.g., spray bars 14-2, 14-3) provided on the dewatering mechanism. In some embodiments, a common washing element rate controller may control spray bars 14-1, 14-2, 14-3.

A slurry water rate controller 1820 (e.g., on-off valve, flow control valve, pressure control valve, variable rate pump, on-off pump switch) may be provided on or remote from the slurrying mechanism 200 (or remote from the slurrying mechanism) for controlling a rate or pressure at which water flows into the inlet 270.

In some embodiments, an incline angle controller 1826 (e.g., a control valve such as an electrohydraulic solenoid valve) may optionally be provided on the slurrying mechanism 200 (or remote from the slurrying mechanism) in embodiments including an incline angle adjustment system, e.g., for controlling a position of the actuator 510 and thus the incline angle As.

Figure 18:
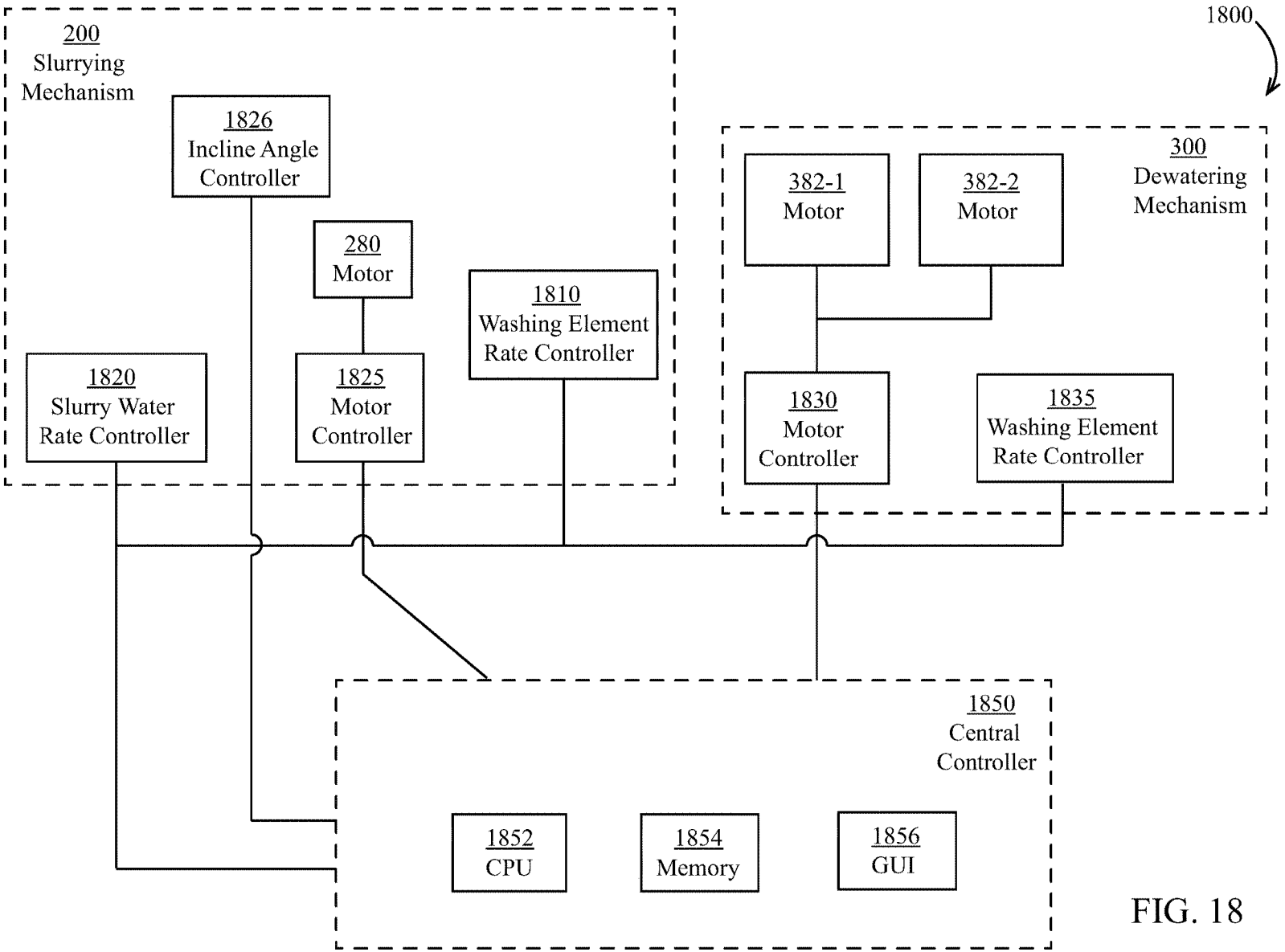
FIG. 18 schematically illustrates an embodiment of a control system for an aggregate washing system.

An alternative optional control system 1800 for controlling the aggregate washing system 100 is schematically illustrated in FIG. 18.

In the system 1800, a motor controller 1825 (e.g., an electrical controller) is optionally provided on the slurrying mechanism 200 for controlling a speed of the motor 280. The motor 280 optionally operates at a speed causing the auger blade 422 to rotate at between 200 and 400 and optionally 300 linear feet per minute. A motor controller 1830 (e.g., an electrical controller) is optionally provided on the dewatering mechanism 300 for controlling a speed of motors 382. The motor controllers 1825, 1830 may be in data communication with a central controller 1850 for sending data (e.g., operational criteria such as motor speed) to and receiving commands (e.g., motor speed commands) from the central controller 1850. In other embodiments the motor speed (or motor speeds) are set by manually changing an operating state of each motor. The central controller 1850 optionally comprises an electronic controller and/or system monitor optionally comprising a CPU 1852, a memory 1854, and a graphical user interface 1856 for displaying system criteria to and receiving data entry (e.g., commands, machine criteria) from an operator.

A washing element rate controller 1810 (e.g., valve or pump) may be provided on the slurrying mechanism 200 for controlling a rate at which fluid (e.g., water) is supplied to and/or dispensed from one or more washing elements (e.g., spray bar 14-1) provided on the slurrying mechanism. A washing element rate controller 1835 (e.g., valve or pump) may be provided on the dewatering mechanism 300 for controlling a rate at which fluid (e.g., water) is supplied to and/or dispensed from one or more washing elements (e.g., spray bars 14-2, 14-3) provided on the dewatering mechanism. In some embodiments, a common washing element rate controller may control spray bars 14-1, 14-2, 14-3. The washing element rate controllers 1810, 1835 may be in data communication with the central controller 1850 for sending data (e.g., flow rates, fluid pressures) to and receiving commands (e.g., commanded flow rates, commanded fluid pressures) from the central controller 1850. In other embodiments, a pump rate at which a pump supplies water to one or more washing elements determines the rate at which water is dispensed from the washing element (e.g., when a valve such as an on-off valve or proportional valve is opened to place the pump in fluid communication with the washing element).

A slurry water rate controller 1820 (e.g., on-off valve, flow control valve, pressure control valve, variable rate pump, on-off pump switch) may be provided on the slurrying mechanism 200 (or remote from the slurrying mechanism) for controlling a rate or pressure at which water flows into the inlet 270. The slurry water rate controller 1820 may be in data communication with the central controller 1850 for sending data (e.g., flow rates, fluid pressures) to and receiving commands (e.g., commanded flow rates, commanded fluid pressures, pump speed, valve on-off state, pump on-off state) from the central controller.

An incline angle controller 1826 (e.g., a control valve such as an electrohydraulic solenoid valve) may be provided on the slurrying mechanism 200 (or remote from the slurrying mechanism) for controlling a position of the actuator 510 and thus the incline angle As. A similar incline angle controller may be provided on or remote from the dewatering mechanism 300 for modifying the incline angle Ad. Each incline angle controller may be in data communication with the central controller 1850 for sending data (e.g., actuator position) to and receiving commands (e.g., commanded actuator position) from the central controller. In some embodiments (such as those in which no angle adjustment assembly is included) the incline angle controller 1826 is optionally omitted.

Further Washing System Embodiments

Figure 15:
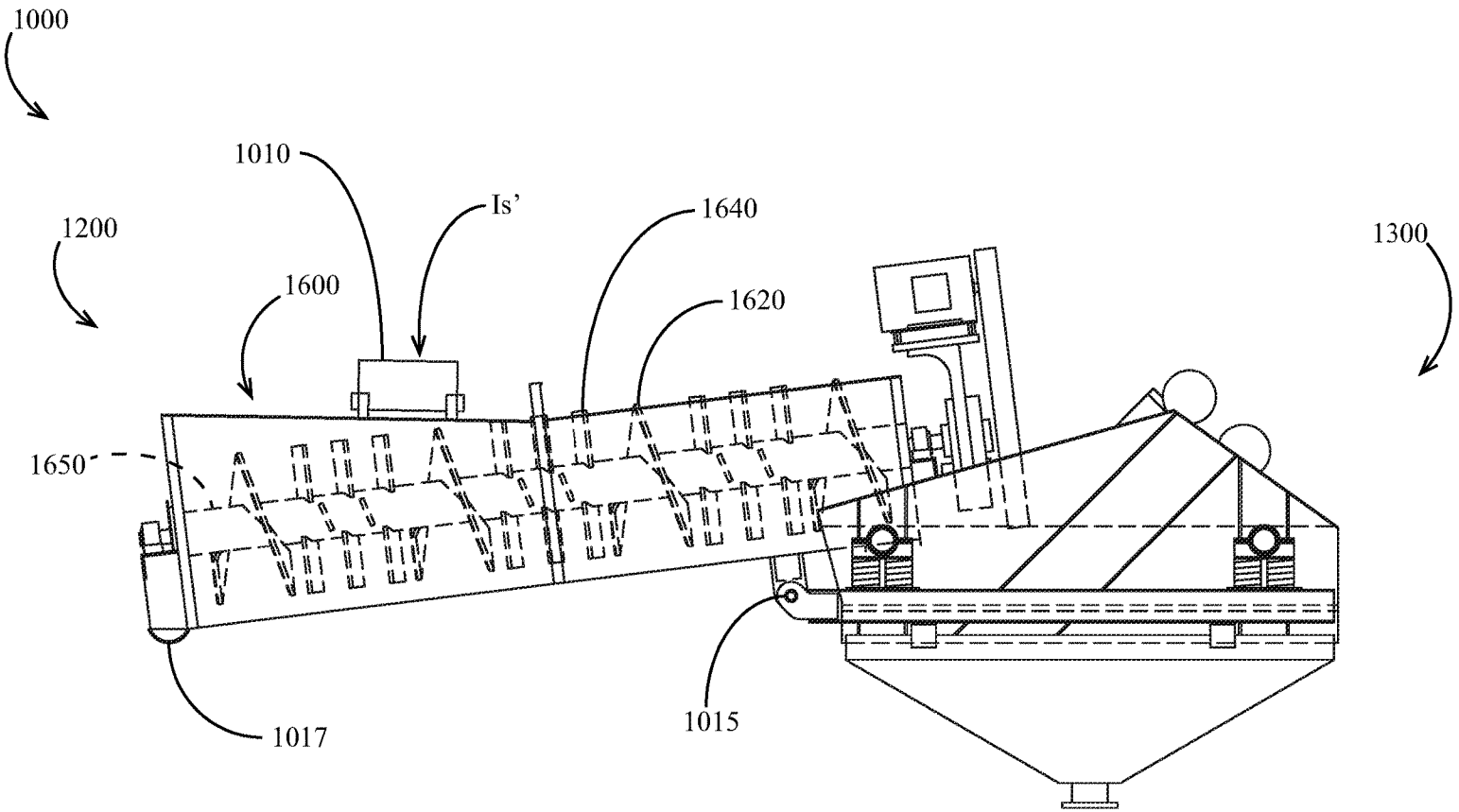
FIG. 15 is a side elevation view of another embodiment of an aggregate washing system.
Figure 16:
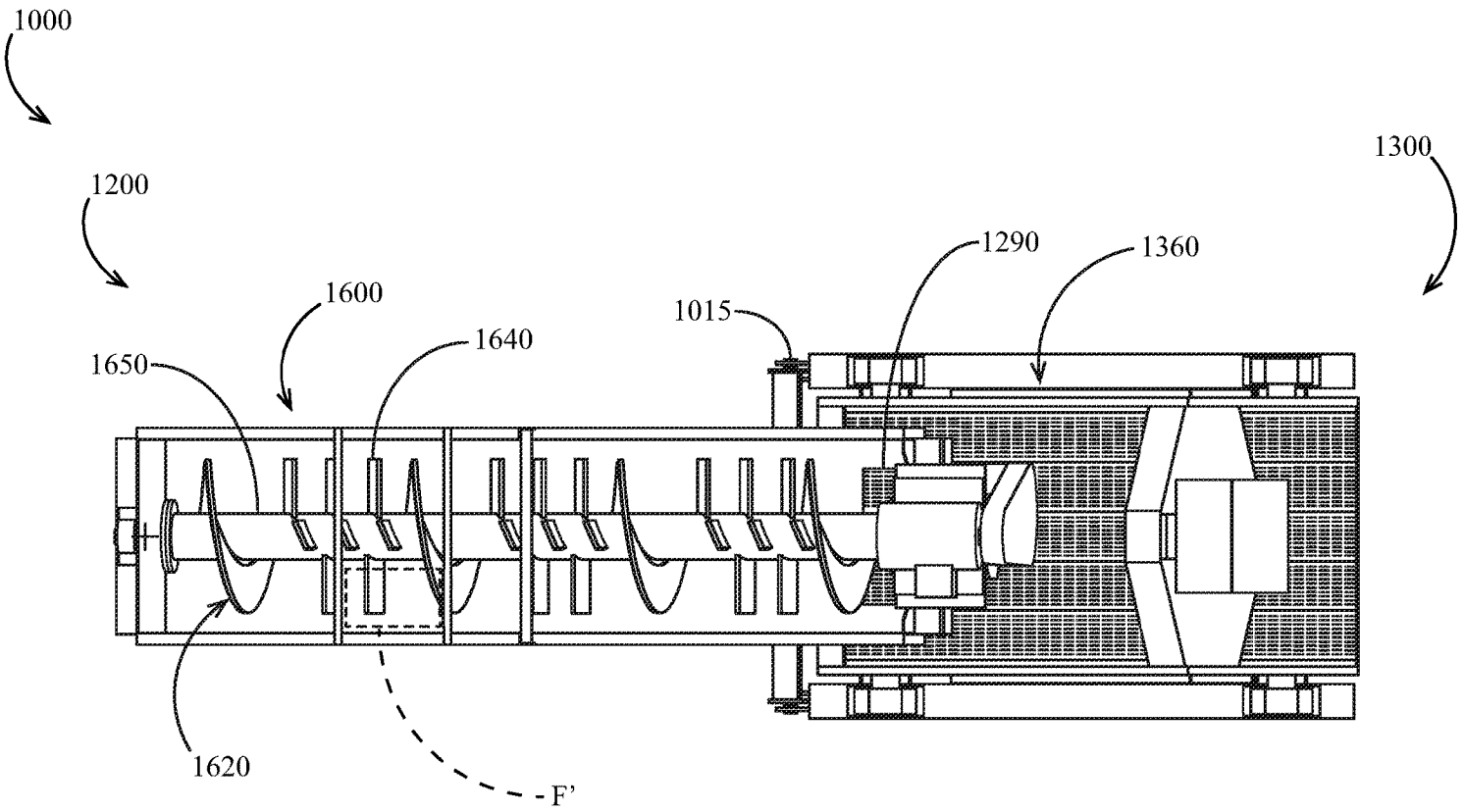
FIG. 16 is a plan view of the aggregate washing system of FIG. 15.

Another embodiment of an aggregate washing system 1000 is illustrated in FIGS. 15 and 16 having a slurrying mechanism 1200 and a dewatering mechanism 1300 arranged in series. The slurrying mechanism 1200 optionally deposits materials through an opening 1290 onto a screen media deck 1360 of the dewatering mechanism 1300, which optionally comprises a vibrating dewatering screen.

The slurrying mechanism 1200 optionally operates generally similarly to the mechanism 200 described above. Differences which will be appreciated are the number of paddle assemblies 1630, 1640 along the shaft 1650 of an alternative propulsion assembly 1600 and the provision of a plurality of augers 1620 along the shaft 1650 with paddle assemblies disposed between subsequent augers. Additionally, a modified inlet Is' optionally comprises a feed box 1010 mounted to the mechanism 1200. The feed box 1010 may be disposed above a modified feed region F' which may be disposed to one side of the shaft 1650.

The aggregate washing system 1000 also optionally includes a hinge 1015 pivotally coupling the slurrying mechanism 1200 to the dewatering mechanism 1300. The hinge 1015 optionally allows modification of the incline angle of the mechanism 200 and/or the incline angle of the mechanism 300. In some embodiments, the incline angle of the mechanism 200 may be modified by changing the height of support structure supporting a footing 1017 (or leg or other support structure) provided on the rearward end of the mechanism 200. In other embodiments the hinge 1015 is omitted and the two dewatering and slurrying mechanisms are either rigidly mounted to one another or separately supported.

The dewatering mechanism 1300 optionally operates generally similarly to the mechanism 300 described above. Differences which will be appreciated include the generally flat screen media deck 1360 extending longitudinally from a rearward end of the dewatering mechanism to the forward (outlet) end of the dewatering mechanism.

Referring to FIGS. 20-25, another embodiment of an aggregate washing system 2100 is illustrated optionally including a slurrying mechanism 2200 (which may be described as an agitator, agitating mechanism, mixer, mixing mechanism, stirring mechanism, slurrifying mechanism, etc. according to some embodiments) and optionally including a dewatering mechanism 2300 (e.g., comprising a classifying mechanism such as a vibratory screen or other mechanism), which may be arranged in series as illustrated such that material (e.g., slurry) processed by the slurrying mechanism 2200 is transferred to the dewatering mechanism 2300. The slurrying mechanism 2200 and dewatering mechanism 2300 are optionally supported by frames 2020, 2030, respectively which are described elsewhere herein. The frames 2020, 2030 may comprise sections of a single rigidly and/or releasably interconnected frame, or may comprise two independent and/or relatively movable frames. The frames 2020, 2030 may be mounted (e.g., by welding) to other structure or may be movably supported by skids, wheels or other mobile structure. Thus the aggregate washing system 2100 may be deployed as a single mobile plant, as a plurality of separate mobile plants, or in a stationary plant setting.

The slurrying mechanism optionally generates a slurry comprising water and aggregate materials introduced to the mechanism through an inlet Is. The slurrying mechanism optionally passes the slurry (e.g., all or substantially of the slurry exiting the slurrying mechanism) from an outlet Os thereof into an inlet Id of the dewatering mechanism. The dewatering mechanism optionally removes water (and/or fines or other undersize material) from the slurry and optionally passes materials such as at least partially washed and/or at least partially dewatered product (e.g., sand) through an outlet Od.

The slurrying mechanism 2200 optionally has at least some features and functionality in common with one or more of the other slurrying mechanism embodiments described herein. The slurrying mechanism 2200 optionally generally comprises a tank 2201 having a propulsion assembly 2400 rotatably supported thereon and driven for rotation by a motor 2280 (optionally via a drive assembly 2286). Rotation of the propulsion assembly 2400 optionally tends to agitate (e.g., mix, slurrify, etc.) aggregate material and water in the tank 2201. Rotation of the propulsion assembly 2400 optionally tends to propel material (e.g., aggregate material, water, mixture, slurry) towards and through an outlet Os of the tank 2201. The outlet Os optionally comprises an opening in the tank (e.g., the bottom surface and/or sidewall thereof) and is optionally disposed on a generally opposite end of the tank 2201 from the inlet Is. Material passing through the outlet Os optionally moves (e.g., by gravity) to (e.g., onto, into, etc.) the dewatering mechanism 2300. In some embodiments, material falls directly from the outlet Os to the dewatering mechanism 2300; in other embodiments, material moves by gravity along a chute or other structure to the dewatering mechanism, and/or is conveyed (e.g., by a belt conveyor or other mechanism) to the dewatering mechanism. In some embodiments, material passes through classifying structure (e.g., wire mesh, a grate, grizzly bars, screen media, etc) before moving to the dewatering mechanism.

During operation of the slurrying mechanism 2200, materials processed by the slurrying mechanism (e.g., aggregate materials, water, and/or slurry) are optionally transferred to the dewatering mechanism 2300. In the illustrated embodiment, optionally materials processed by the slurrying mechanism 2200 are only transferred to (e.g., directly deposited into) the dewatering mechanism 2300. In other words, the slurrying mechanism optionally exclusively transfers the processed materials (e.g., slurry) to the dewatering mechanism. In the illustrated embodiment, the walls of the slurrying mechanism 2200 optionally cooperate to retain slurry in the tank 2201 of the slurrying mechanism such that water introduced into the slurrying mechanism is directed (and optionally substantially and/or exclusively directed) to the dewatering mechanism 2300 (e.g., through the outlet Os.) In normal operation, the slurrying mechanism 2200 optionally prevents water (and/or other materials) from escaping the tank 2201 (e.g., by preventing overflow of the sidewalls thereof) other than through the outlet Os. For example, some or all of the upper edges of the walls of the tank 2201 (e.g., sidewalls, forward and rearward walls) are optionally disposed higher than the outlet Os such that as the tank 2201 fills, material and/or water exits the outlet Os before the tub can fill beyond the upper edge of any wall of the tub. The tub (e.g., the rearward wall and/or rearward ends of the sidewalls of slurrying mechanism 2200) is optionally free of any weir or other overflow wall and/or channel.

The slurrying mechanism 2200 optionally includes one or more grates 2202 supported generally above an upper opening of the tank 2201. The grates 2202 (e.g., a rearward grate 2202-1 and forward grate 2202-2) are optionally disposed on top of the tank 2201 as illustrated. Aggregate material is optionally deposited into the tank 2201 through the grates 2202 and/or through the top of the tank 2201. In various embodiments the grates may be replaced with other classifying structure such as wire mesh, screen media or grizzly bars and may be mounted directly to or separate from the tank 2201.

Figure 22:
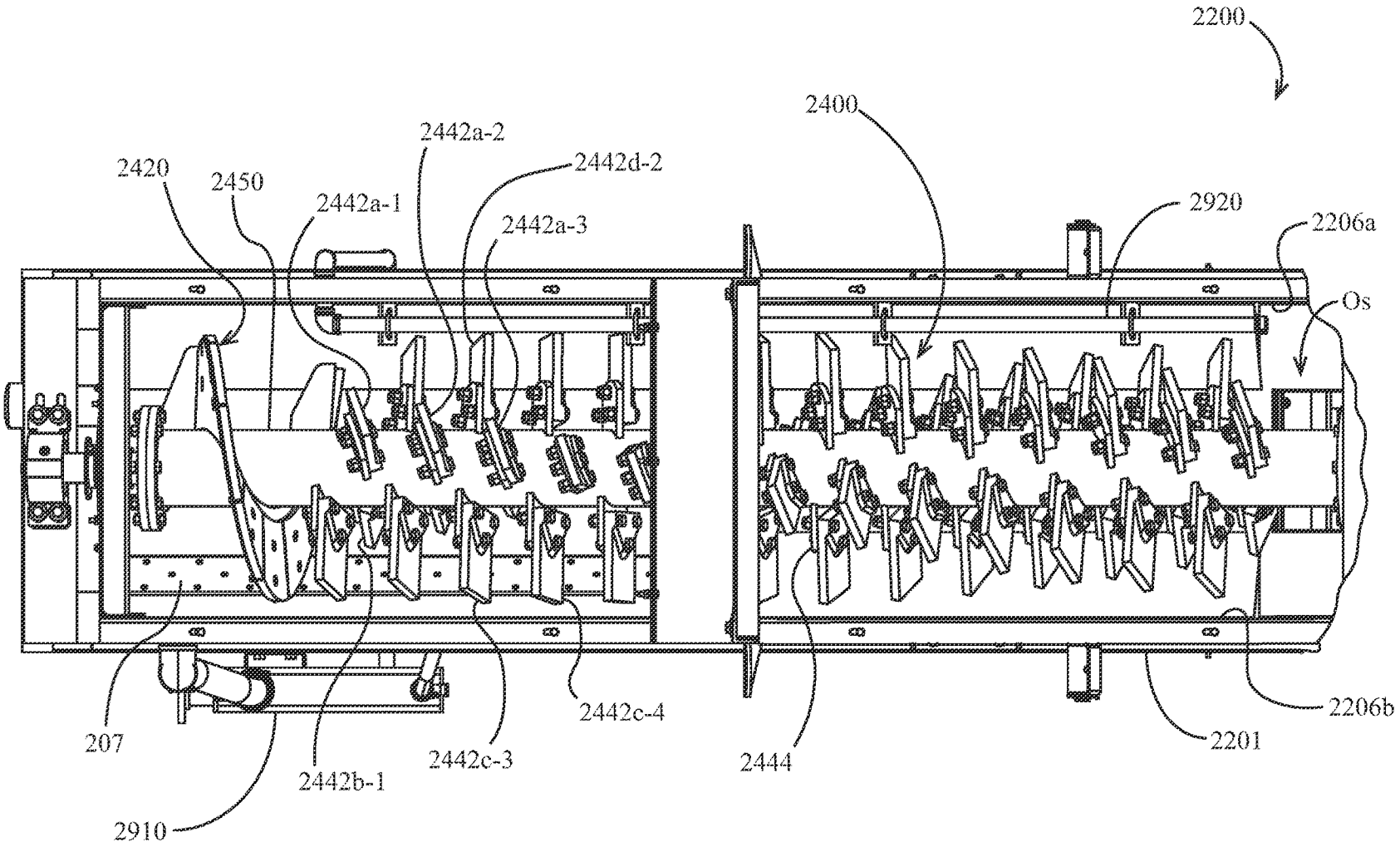
FIG. 22 is an expanded partial plan view of the aggregate washing system of FIG. 20 with certain components not shown for clarity.

Referring to FIG. 22, in some embodiments the propulsion assembly 2400 optionally comprises a shaft 2450 with a plurality of paddles 2442 extending therefrom. The paddles 2442 optionally extend generally radially from the shaft (e.g., along a radial direction normal to the axis of rotation of the shaft). The paddles 2442 are optionally angled relative to a transverse plane (e.g., a transverse plane normal to the axis of rotation of the shaft) such that movement of the paddles through the material in the tank 2201 tends to urge material toward the outlet Os. The paddles 2442 are optionally removably mounted to the shaft 2450 (e.g., by bolting to a mounting base 2444 supported on the shaft).

In some embodiments, one or more paddle sets are circumferentially arranged about the shaft 2450. In one example illustrated in FIG. 22, the propulsion assembly 2400 includes a first set of paddles 2442*a*, a second set of paddles 2442*b*, a third set of paddles 2442*c*, and a fourth set of paddles 2442*d*. Each set of paddles is optionally arranged in a spiral pattern; e.g., each paddle along the length of the shaft 2450 in each paddle set is optionally disposed at a radial offset (e.g., between 0 and 30 degrees, between 0 and 15 degrees, between 0 and 10 degrees, etc.) from an adjacent paddle. One or more paddles in one paddle set (e.g., one or more paddles 2242*a*) are optionally disposed on a generally opposing side of the shaft 2450 from one or more paddles in another paddle set (e.g., one or more paddles 2242*b*). One or more paddles in one paddle set (e.g., one or more paddles 2242*a*) are optionally angled about a transverse plane at an opposing and/or opposite angle to one or more paddles in another paddle set (e.g., one or more paddles 2242*b*).

In some embodiments, an auger 2420 is mounted to the shaft 2450. The auger 2420 is optionally disposed at a rearward end of the shaft 2450. Rotation of the auger 2420 through material disposed at the rearward end of the tank 2201 optionally displaces material upward and forward toward the paddles 2442. In some embodiments, the paddles 2442 are arranged along a length of the shaft 2450 extending from the auger 2420 to the forward end of the shaft 2450 (e.g., to the outlet Os). In various embodiments, the auger 2420 may comprise one auger flight or a plurality of auger flights.

Figure 20:
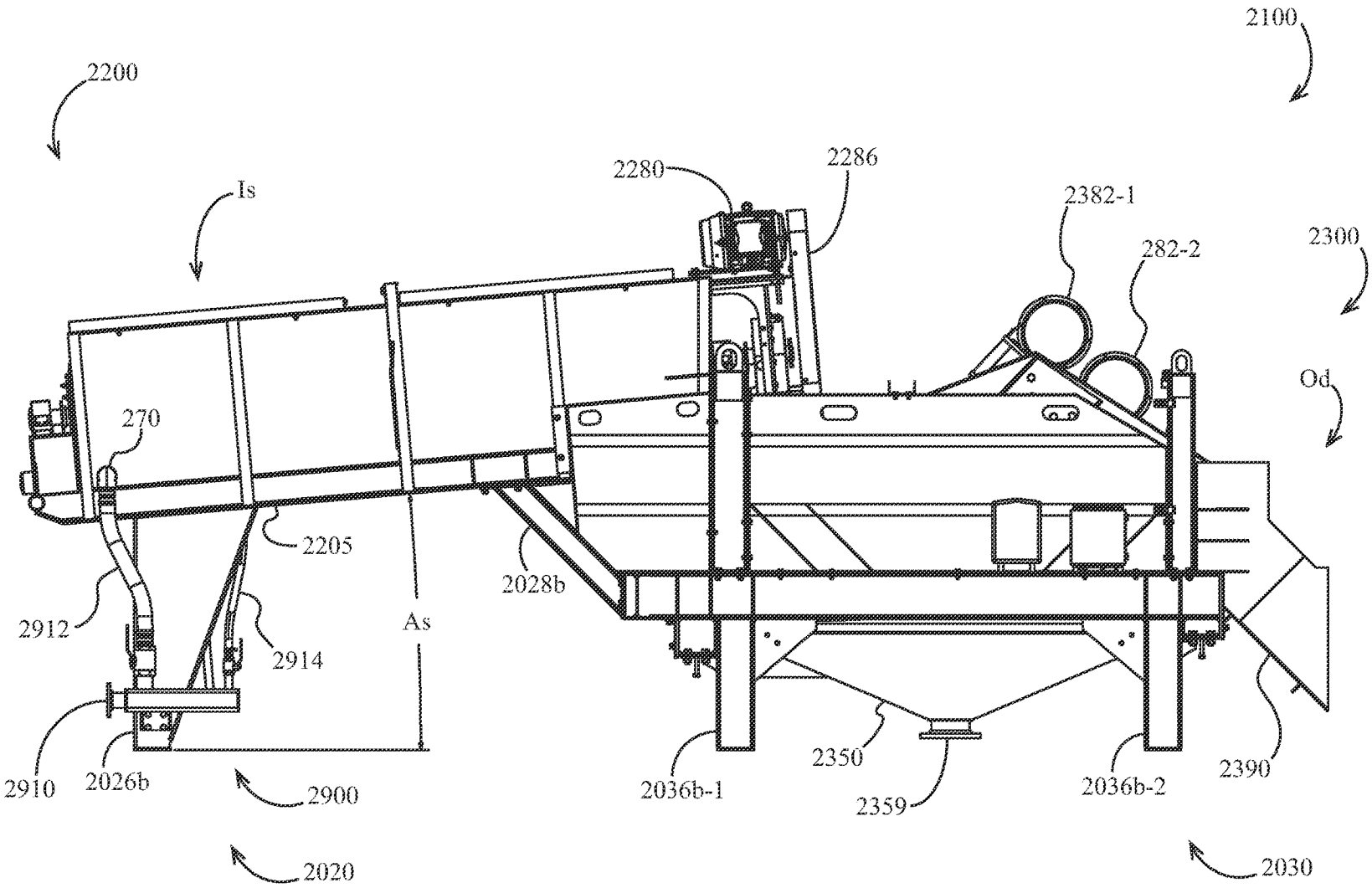
FIG. 20 is a side elevation view of another embodiment of an aggregate washing system.
Figure 21:
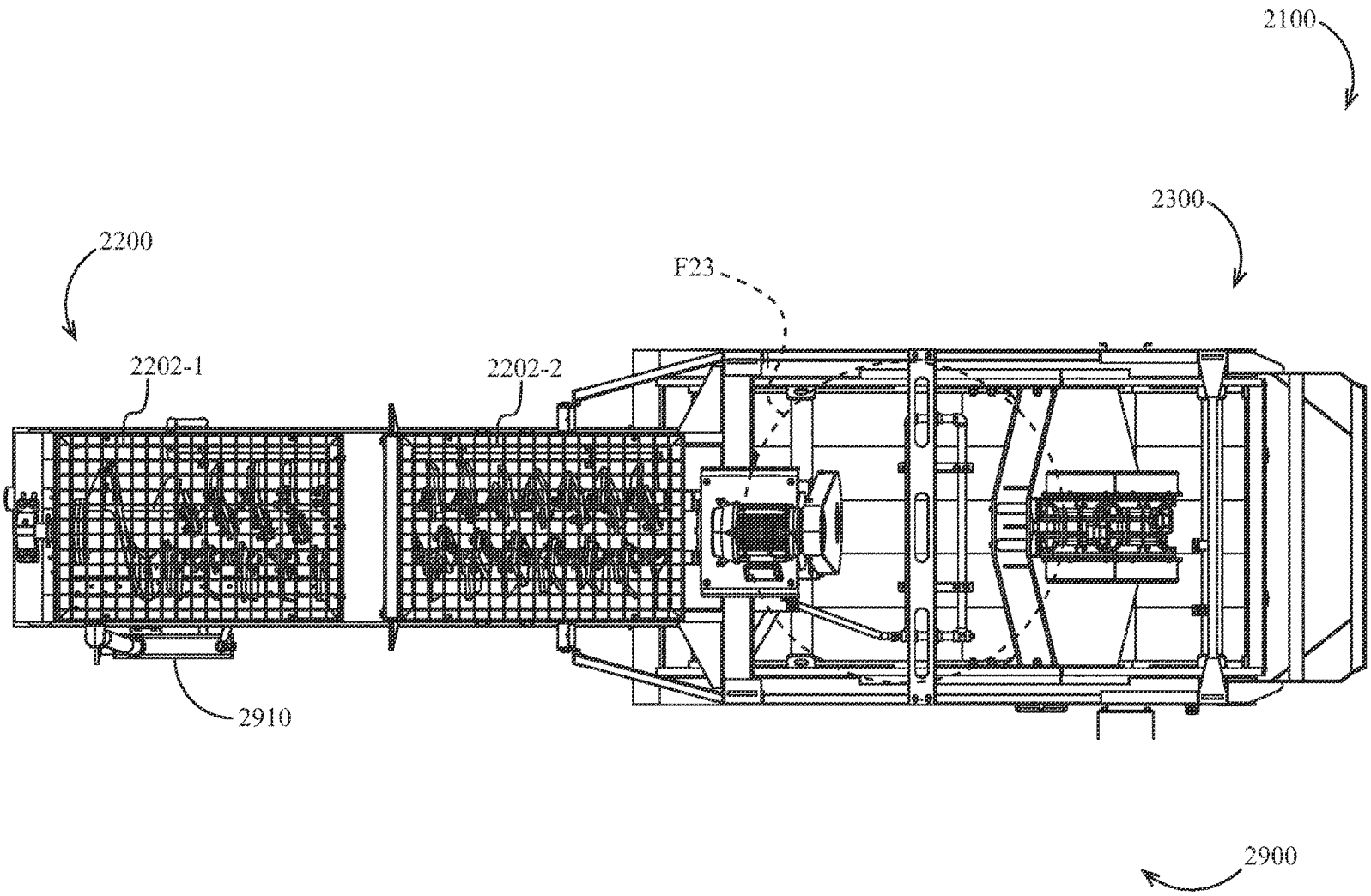
FIG. 21 is a plan view of the aggregate washing system of FIG. 20.

Referring to FIG. 20, in various embodiments the angle As at which the bottom 2205 of tank 2201 is angled relative to a horizontal plane is 5 degrees, approximately 5 degrees, between 4 and 6 degrees, between 3 and 7 degrees, between about 4 and about 6 degrees, between 0 and 10 degrees, between 0 and 30 degrees, between 0 and 45 degrees, etc. In the embodiment of FIG. 20, the angle As is fixed. In alternative embodiments, the angle As is adjustable as described with respect to other embodiments disclosed herein.

In some embodiments, the slurrying mechanism 2200 comprises more than one propulsion assembly 2400. For example, in such embodiments two or more propulsion assemblies may be disposed in side-by-side relation in the tank 2201. In such embodiments the paddles optionally overlap (e.g., paddles of one propulsion assembly optionally extend into the bounding envelope of the other propulsion assembly). In such embodiments, the propulsion assemblies may be driven by a common motor or by separate motors.

Figure 25:
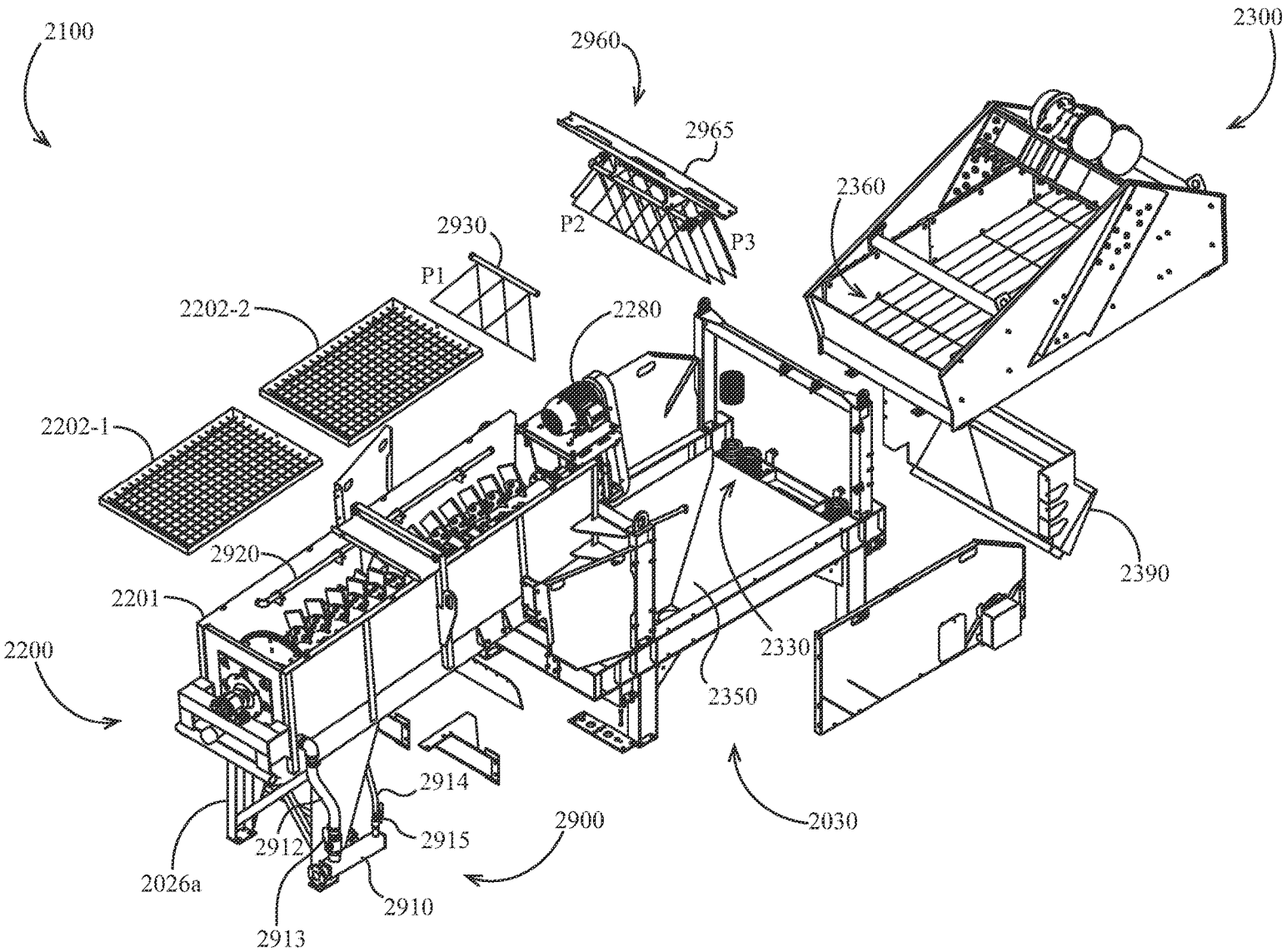
FIG. 25 is an exploded perspective view of the aggregate washing system of FIG. 20.

Referring to FIGS. 20 and 25, the dewatering mechanism 2300 optionally comprises a dewatering screen. The dewatering mechanism may be driven for vibration (e.g., circular, elliptical, linear, etc.) by one or more motors 2382. In various implementations, the motors may operate at between 0 and 3000 RPM (e.g., 900 or 1800 RPM). One or more screen media decks 1360 is optionally supported on the dewatering mechanism (e.g., by sidewalls thereof). In some implementations vibration of the screen imposes accelerations of between 2 g and 6 g (e.g., about 2 g, greater than 2 g, about 3 g, greater than 3 g, 4 g, about 4 g, greater than 4 g, 5 g, about 5 g, greater than 5 g) on the deck 2360. The deck 2360 is optionally at least partially upwardly inclined at an angle Ad (e.g., between 0 and 10 degrees, between 0 and 5 degrees, between 0 and 4 degrees, between 1 and 3 degrees, 1 degree, about 1 degree, 2 degrees, about 2 degrees, 3 degrees, about 3 degrees, 4 degrees, about 4 degrees, etc.). The deck 2360 may be of various sizes and configurations according to various embodiments; in some embodiments the deck 2360 is more than two times longer than its width, such as 4 times longer than its width (e.g., the deck is optionally about 10 feet wide and about 40 feet long in some embodiments).

Oversize material deposited on the deck 2360 (e.g., from the opening Os of the slurrying mechanism) optionally moves across the screen to the outlet Od. The oversize material optionally slides down an optional chute 2390 which may be mounted to the dewatering mechanism at the outlet Od. Undersize material (e.g., contaminant, non-saleable material, etc.) and/or water deposited on the deck 2360 (e.g., from the opening Os of the slurrying mechanism) optionally falls through the deck 2360 and into an underflume 2350. The underflume 2350 optionally includes a lower opening 2359 into which undersize material and/or water may be directed for further processing and/or storage.

Figure 23:
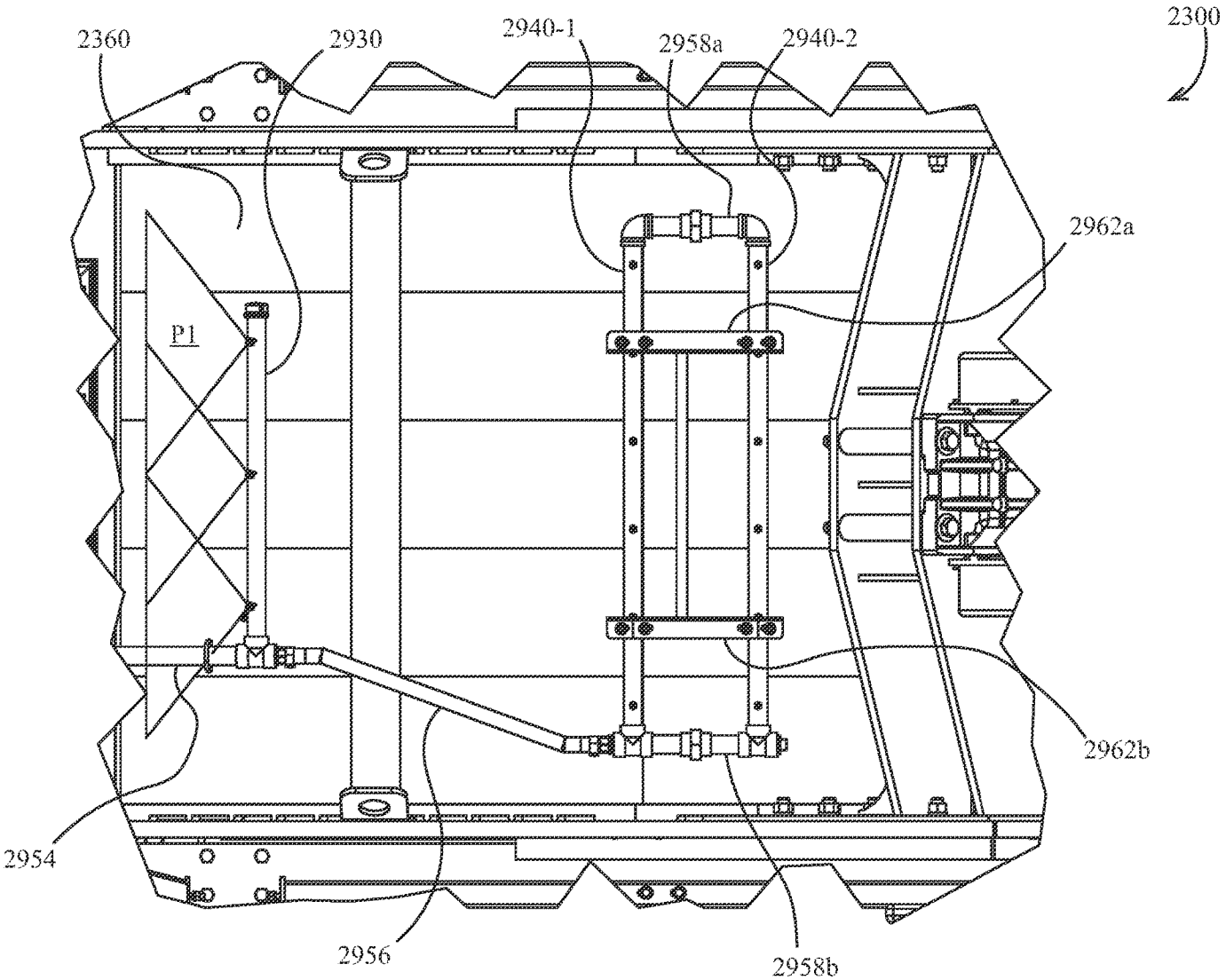
FIG. 23 is a detail of the area F23 of FIG. 21 with certain components not shown for clarity.

Referring to FIGS. 20, 23, and 25, the aggregate washing system optionally includes one or more water inputs. A water manifold 2900 in fluid communication with a fluid source (e.g., a pump for pumping water or other fluid) optionally comprises a common inlet 2910 for the various water inputs described herein; in other embodiments, a plurality of inlets may be used to connect the various water inputs to the water source. One or more pumps (not shown) or other devices are optionally used to transfer water to the aggregate washing system.

Figure 26:
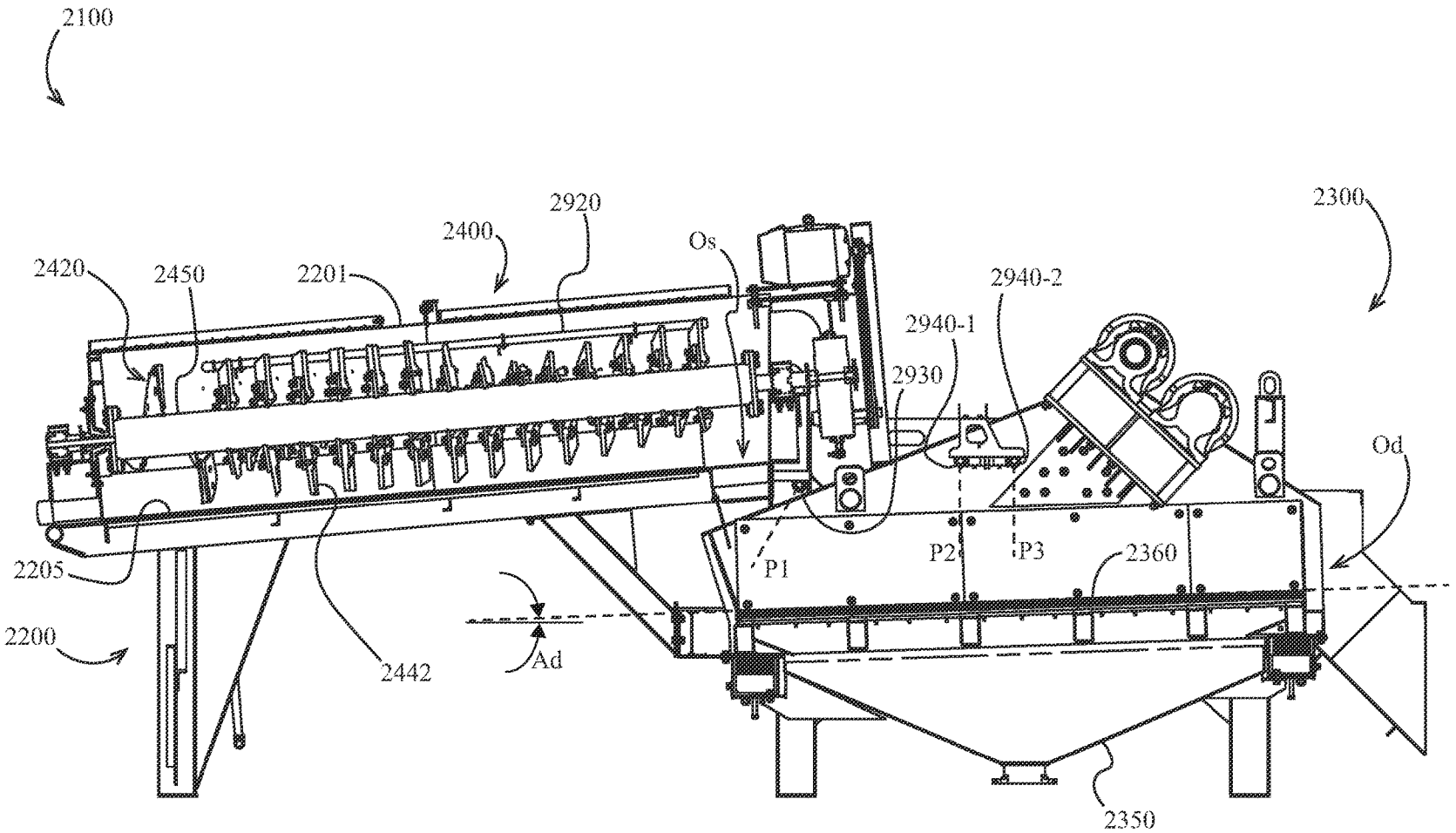
FIG. 26 is a sectional view along the section 24-24 of FIG. 24.

Referring to FIGS. 23 and 26, in some embodiments one or more spray bars 2940 are supported over the deck 2360 and optionally disposed to spray water onto material on the deck. In the illustrated embodiment, two spray bars 2940 are disposed above the deck 2360. Each spray bar 2940 optionally comprises a plurality of nozzles disposed along the length of the spray bar and oriented generally downward, angled rearward of vertical (e.g., between 0 and 45 degrees from vertical, between 10 and 30 degrees from vertical, between 10 and 20 degrees from vertical, about 15 degrees from vertical, etc.) or angled forward of vertical. The spray pattern P created by each nozzle (e.g., spray patterns P1, P2, P3 as shown in FIG. 26) is optionally generally planar in some embodiments or may be conical or have other shapes according to various embodiments. Each spray bar optionally extends generally transversely as illustrated; in other embodiments, one or more spray bars may be oriented at an angle relative to a horizontal and/or vertical plane.

Each spray bar is optionally in fluid communication with a fluid (e.g., water) source; in some embodiments, the spray bars 2940 are in fluid communication with the inlet 2910 via a conduit 2914 (e.g., flexible or inflexible conduit). In some embodiments, flow of water or other fluid to the spray bars 2940 (and/or additional spray bars described herein) may be selectively at least partially blocked by a valve 2915 (e.g., a ball valve or other valve which may be manually controlled by a user interface such as a lever or dial, or remotely controlled by an electrical or pilot signal). In some embodiments, the flow rate and/or pressure of water delivered to the spray bars 2940 (and/or additional spray bars described herein) may be selectively modified by changing an operating state of the valve 2915.

In some embodiments, a first end of a first (e.g., rearward) spray bar 2940-1 is fluidly coupled to a first end of the second (e.g., forward) spray bar 2940-2 by one or more conduits 2958*a*. In some embodiments, a second end of the first spray bar 2940-1 is fluidly coupled to a second end of the second spray bar 2940-2 by one or more conduits 2958*b*.

Referring to FIGS. 23 and 25, a support frame 2960 optionally at least partially supports the spray bars 2940. The support frame 2960 is optionally supported by a support (not shown) such as a frame which is separate from the screen such that the support frame 2960 and/or spray bars dependent therefrom are optionally vibrationally isolated from the vibrating portion of the dewatering mechanism 2300. The support frame 2960 optionally comprises one or more members 2962 (e.g., 2962*a* and 2962*b*) to which the spray bars 2940 are releasably mounted (e.g., by U-bolts or other removable fasteners). The members 2962 optionally extend longitudinally as illustrated. The members 2962 are optionally mounted to a common support member 2965; the support member 2965 optionally extends laterally (e.g., generally parallel with the spray bars 2940) as illustrated.

Referring to FIGS. 23 and 25, a spray bar 2930 is optionally positioned at or near a forward end of the slurrying mechanism 2200 and/or at or near a rearward end of the dewatering mechanism 2300. The spray bar 2930 optionally extends generally transversely as illustrated. The spray bar 2930 is optionally disposed at height beneath the opening Od and/or at a height above the deck 2360. In some embodiments, spray nozzles disposed along the length of the spray bar 2930 are optionally oriented to spray material moving (e.g., falling) from the opening Od to the deck 2360. In some embodiments, spray nozzles disposed along the length of the spray bar 2930 are optionally oriented to spray material on a rearward portion of the deck 2360. In some embodiments, the spray bar 2930 is supported on the slurrying mechanism 2200; in alternative embodiments, the spray bar 2930 is optionally supported on the frame 2960 and/or on other structure which is optionally separate (and/or substantially vibrationally isolated) from the dewatering mechanism 2300.

The spray bar 2930 is optionally in fluid communication with a water source; for example, the spray bar may be coupled to the inlet 2910 via one or more conduits (e.g., conduits 2954 and/or 2914 which may be rigid or flexible according to various embodiments) which may be flexible or inflexible. The spray bar 2930 is optionally fluidly coupled to one or more spray bars 2940 (e.g., via conduit 2956 which may be rigid or flexible according to various embodiments).

Referring to FIGS. 22 and 25, a spray bar 2920 or other washing element is optionally disposed to direct one or more spray nozzles thereof toward a sidewall 2206 of the tank 2201. The spray bar 2920 is optionally mounted (e.g., directly or indirectly) to one of the sidewalls 2206 (e.g., sidewall 2206*a* as illustrated or sidewall 2206*b*). One or more spray patterns or other fluid movements generated by the spray nozzles or other washing features of the spray bar 2920 optionally tend to remove aggregate material from sidewall 2206*a* and/or prevent aggregate material from building up on the sidewall 2206*a*. In some embodiments, the spray bar 2920 optionally extends generally longitudinally. In some embodiments, the spray bar 2920 optionally extends generally parallel to the shaft 2450. The spray bar 2920 is optionally disposed adjacent to the propulsion assembly 2400. The spray bar 2920 is optionally disposed toward the upper end of the sidewall 2206 (e.g., above a midpoint height thereof). According to various embodiments, one or more spray nozzles disposed along the length of the spray bar 2920 are optionally oriented towards the sidewall 2206*a* (e.g., generally horizontally oriented, oriented between 0 and 45 degrees below horizontal, about 30 degrees below horizontal, about 45 degrees below horizontal, about 60 degrees below horizontal, between 45 and 80 degrees below horizontal, between 60 and 80 degrees below horizontal, etc.). The spray bar 2920 is optionally in fluid communication with a water source (e.g., via inlet 2910 and/or conduit 2915).

In some embodiments, the slurrying mechanism optionally includes one or more inlets 270 and/or restrictions 207 for creating currents (e.g., rising currents) in the tank 2201. In some such embodiments, the inlet or inlets 270 are in fluid communication with the inlet 2910 (e.g., via a conduit 2912). A valve 2913 (e.g., ball valve or other valve) optionally selectively couples the conduit 2912 to the inlet 2910. The valve 2913 is optionally configured to selectively modify the rate and/or pressure of fluid flow from the inlet 2910 to the inlet 270 (e.g., by closing the valve, partially opening the valve, or fully opening the valve). In some embodiments, the valve 2913 is manually operated (e.g., by a user interface such as a dial or lever); in other embodiments, an electronic controller or pilot pressure controller may be used to change an operating state of the valve 2913.

Figure 24:
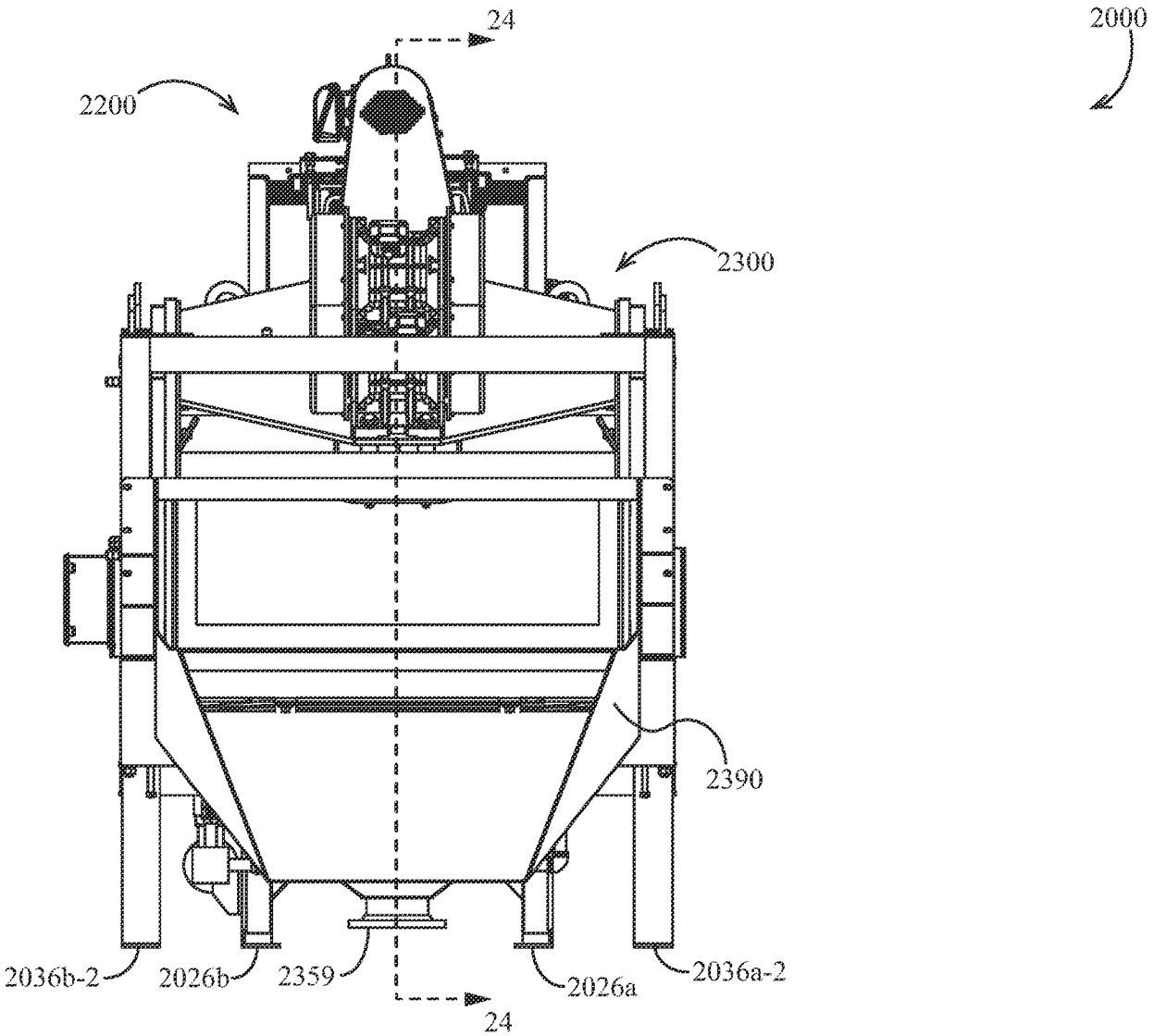
FIG. 24 is a front elevation view of the aggregate washing system of FIG. 20.

Referring to FIGS. 20, 24 and 25, a support frame 2020 optionally at least partially supports the slurrying mechanism 2200. In some embodiments, the support frame 2020 comprises one or more legs 2026 (e.g., left leg 2026*a* and right leg 2026*b*) which may be disposed at or near a rearward end of the tank 2201 as illustrated. A support frame 2030 optionally at least partially supports the dewatering mechanism 2300; for example, the deck 2360 and associated sidewalls and motors may be resiliently supported on a plurality of spring assemblies 2330 disposed on the frame 2030. The underflume 2350 is optionally mounted to the frame 2030. The spray bar support frame 2960 is optionally supported on the support frame 2030. In some embodiments, the slurrying mechanism 2200 is also at least partially supported by (e.g., rigidly mounted to, rested on, hingedly mounted to) a frame 2030 (e.g., at or near a forward end of the slurrying mechanism); in other embodiments, the slurrying mechanism 2200 may be completely (and/or independently) supported by the support frame 2020. In some embodiments, the frame 2030 comprises a plurality of legs 2036; in the illustrated embodiment, left and right legs 2036*a*-1, 2036*b*-1 respectively support the frame 2030 at or near a rearward end thereof and left and right legs 2036*a*-2, 2036*b*-2 respectively support the frame 2030 at or near a forward end thereof.

The aggregate washing system embodiments described herein may be incorporated in mobile or stationary plants either alone or in combination with other equipment such as one or more conveyors (e.g., belt conveyors), one or more crushers (e.g., cone crushers, jaw crushers, gyratory crushers, impact crushers, etc.), and/or one or more classifiers (e.g., vibratory screens, grizzly feeders, hydraulic classifiers, hydrocyclones, etc.).

Ranges recited herein are intended to inclusively recite all values and sub-ranges within the range provided in addition to the maximum and minimum range values. Headings used herein are simply for convenience of the reader and are not intended to be understood as limiting or used for any other purpose.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. An aggregate washing system, comprising:

a slurry mixer, said slurry mixer comprising:

a tank disposed at a first incline angle, the tank having a rearward portion with an aggregate material inlet for receiving aggregate material, the tank having a forward portion with a tank outlet comprising an opening in the tank, said rearward portion having a rear wall and first and second sidewalls, said rear wall having an upper edge disposed higher than said opening;

a water inlet for supplying water to said tank;

a propulsion assembly rotatably supported at least partially within said tank and extending from the rearward portion to the forward portion, wherein said propulsion assembly comprises a shaft, wherein said propulsion assembly comprises a plurality of paddles mounted to said shaft, each of said paddles extending radially outwardly from a rotational axis of said shaft and arranged in a generally spiral arrangement, wherein rotation of said propulsion assembly agitates said water and said aggregate material to form a slurry, wherein rotation of said propulsion assembly conveys said slurry from said rearward portion to the forward portion toward said tank outlet, wherein said rearward portion of the tank retains substantially all water that does not exit said opening of said tank outlet such that substantially all water exiting said rearward portion of the tank exits via said propulsion assembly advancing slurry toward said tank outlet;

a dewatering mechanism disposed to receive said slurry that passes through said opening from said tank outlet of said slurry mixer, said dewatering mechanism comprising:

a vibrating screen having a screen media deck for separating oversize material in said slurry from water and undersize material in said slurry, the screen media deck having a plurality of openings for receiving water and undersize material, the screen media deck having an end over which oversize material is deposited; and at least a first washing element separate from said opening disposed to direct water toward said slurry on said screen media deck.

2. The aggregate washing system of claim 1, wherein said screen media deck is disposed at a second incline angle.

3. The aggregate washing system of claim 2, wherein said first incline angle is between 2 and 8 degrees, and wherein said second incline angle is between 0 and 4 degrees.

4. The aggregate washing system of claim 3, wherein said screen media deck is vibrated at an acceleration greater than 3 g.

5. The aggregate washing system of claim 4, wherein a length of said screen media deck is at least twice a width of said screen media deck.

6. The aggregate washing system of claim 2, wherein at least one of said first and second incline angles is selectively adjustable.

7. The aggregate washing system of claim 1, wherein said dewatering mechanism is mounted to said slurry mixer.

8. The aggregate washing system of claim 1, wherein said dewatering mechanism is separate from said slurry mixer.

9. The aggregate washing system of claim 1, further comprising a second washing element, said second washing element being disposed to apply water to slurry being deposited from the tank opening.

10. The aggregate washing system of claim 1, further comprising a second washing element, said second washing element being disposed to apply water to a sidewall of said tank.

11. The aggregate washing system of claim 1, further comprising a restriction plate mounted to said tank, wherein said restriction plate has a plurality of openings, wherein said restriction plate is disposed between said water inlet and said propulsion assembly.

12. The aggregate washing system of claim 1, further comprising an underflume disposed beneath said screen media deck.

13. The aggregate washing system of claiml, wherein said propulsion assembly comprises an auger, wherein said plurality of paddles are disposed along a length of said shaft between said auger and said tank outlet.

14. An aggregate washing system, comprising:

a slurry mixer, said slurry mixer comprising:

a tank disposed at a first incline angle, the tank having a lower portion with an aggregate material inlet for receiving aggregate material, the tank having an upper portion with a tank outlet, said lower portion having a rear wall and first and second sidewalls, said rear wall extending to a height higher than said tank outlet;

a water inlet for supplying water to said tank;

a propulsion assembly rotatably supported at least partially within said tank and extending from the lower portion to the upper portion, wherein rotation of said propulsion assembly agitates said water and said aggregate material to form a slurry, wherein rotation of said propulsion assembly conveys said slurry from said lower portion to the upper portion toward said tank outlet, wherein said lower portion of the tank retains substantially all water that does not exit said tank outlet such that substantially all water exiting said lower portion of the tank exits via said propulsion assembly toward said tank outlet;

a dewatering mechanism disposed to receive said slurry from said tank outlet of said slurry mixer, said dewatering mechanism comprising:

a vibrating screen having a screen media deck for separating oversize material in said slurry from water and undersize material in said slurry, the screen media deck having a plurality of openings for receiving water and undersize material, the screen media deck having an end over which oversize material is deposited;

at least a first washing element disposed to direct water toward said screen media deck, wherein said screen media deck is disposed at a second incline angle, wherein said first incline angle is between 2 and 8 degrees, and wherein said second incline angle is between 0 and 4 degrees, wherein said screen media deck is vibrated at an acceleration greater than 3 g, wherein a length of said screen media deck is at least twice a width of said screen media deck.

15. The aggregate washing system of claim 14, wherein at least one of said first and second incline angles is selectively adjustable.

16. The aggregate washing system of claim 14, wherein said dewatering mechanism is mounted to said slurry mixer.

17. The aggregate washing system of claim 14, wherein said dewatering mechanism is separate from said slurry mixer.

18. The aggregate washing system of claim 14, further comprising a second washing element, said second washing element being disposed to apply water to slurry being deposited from the tank opening.

19. The aggregate washing system of claim 14, further comprising a second washing element, said second washing element being disposed to apply water to a sidewall of said tank.

20. The aggregate washing system of claim 14, further comprising a restriction plate mounted to said tank, wherein said restriction plate has a plurality of openings, wherein said restriction plate is disposed between said water inlet and said propulsion assembly.

21. The aggregate washing system of claim 14, further comprising an underflume disposed beneath said screen media deck.

22. The aggregate washing system of claim 14, wherein said propulsion assembly comprises a shaft, wherein said propulsion assembly comprises a plurality of paddles mounted to said shaft.

* * * * *